US006602089B2

(12) United States Patent
Abe et al.

(10) Patent No.: US 6,602,089 B2
(45) Date of Patent: Aug. 5, 2003

(54) AUXILIARY MACHINE MODULE AND METHOD OF MANUFACTURING THE SAME

(75) Inventors: Kimihiro Abe, Shizuoka (JP); Isao Kameyama, Shizuoka (JP); Takakazu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/974,058

(22) Filed: Oct. 11, 2001

(65) Prior Publication Data

US 2002/0045376 A1 Apr. 18, 2002

(30) Foreign Application Priority Data

Oct. 13, 2000 (JP) ..... 2000-313736

(51) Int. Cl.[7] ..... H01R 11/20
(52) U.S. Cl. ..... 439/404; 439/417; 29/854
(58) Field of Search ..... 439/404, 389, 439/733.1, 417, 409; 29/832, 854, 857

(56) References Cited

U.S. PATENT DOCUMENTS

| | | | | | |
|---|---|---|---|---|---|
| 4,533,201 | A | * | 8/1985 | Wasserlein, Jr. | 439/391 |
| 5,009,612 | A | * | 4/1991 | Rishworth et al. | 439/403 |
| 5,403,200 | A | * | 4/1995 | Chen | 439/404 |
| 5,601,447 | A | * | 2/1997 | Reed et al. | 439/404 |
| 5,624,274 | A | * | 4/1997 | Lin | 439/417 |
| 5,833,486 | A | * | 11/1998 | Shinozaki | 439/404 |
| 5,911,594 | A | * | 6/1999 | Baker et al. | 439/404 |
| 5,947,761 | A | * | 9/1999 | Pepe | 439/409 |
| 5,954,541 | A | * | 9/1999 | Ozai et al. | 439/404 |
| 5,957,720 | A | * | 9/1999 | Boudin | 439/409 |
| 5,971,792 | A | * | 10/1999 | Lin | 439/404 |
| 6,019,627 | A | * | 2/2000 | Embo et al. | 439/412 |
| 6,027,362 | A | * | 2/2000 | LaCroix | 439/404 |
| 6,062,895 | A | * | 5/2000 | Lin et al. | 439/404 |
| 6,080,006 | A | * | 6/2000 | Broder | 439/409 |
| 6,093,048 | A | * | 7/2000 | Arnett et al. | 439/404 |
| 6,238,231 | B1 | * | 5/2001 | Chapman et al. | 439/395 |
| 6,280,231 | B1 | * | 8/2001 | Nicholls | 439/402 |
| 6,287,149 | B1 | * | 9/2001 | Elkhatib et al. | 439/417 |
| 6,315,596 | B1 | * | 11/2001 | Chen | 439/417 |
| 6,319,047 | B1 | * | 11/2001 | Kang | 439/404 |
| 6,328,592 | B1 | * | 12/2001 | Burke et al. | 439/404 |
| 6,338,643 | B1 | * | 1/2002 | Miller et al. | 439/417 |
| 6,375,490 | B1 | * | 4/2002 | Yao | 439/417 |

FOREIGN PATENT DOCUMENTS

| | | |
|---|---|---|
| JP | 5-326069 | 12/1993 |
| JP | 6-72119 | 10/1994 |
| JP | 7-42075 | 7/1995 |

* cited by examiner

*Primary Examiner*—P. Austin Bradley
*Assistant Examiner*—Edwin A. León
(74) *Attorney, Agent, or Firm*—Armstrong, Westerman & Hattori, LLP

(57) ABSTRACT

An auxiliary machine module includes auxiliary machine a base plate equipped with the auxiliary machine; a case in which the base plate is mounted, and a connector tool for electrically connecting the base plate and the case. In this configuration, the number of components provided on the periphery of the auxiliary machine module, and the module can be reduced in size and weight in a simple structure. An inconvenience occurring in a conventional assembling operation can be also overcome.

9 Claims, 11 Drawing Sheets

AUXILIARY MACHINE MODULE AND METHOD OF MANUFACTURING THE SAME

BACKGROUND OF THE INVENTION

1. Field of the Invention

This invention relates to an auxiliary machine module which can connector-connect an auxiliary machine such as an in-vehicle CCD camera, base plate equipped with the auxiliary machine and case on which the auxiliary machine and base plate are installed, thus providing good productivity and high production yield.

2. Description of the Related Art

Now referring to FIGS. 13 to 16, an explanation will be given of conventional camera modules Y and Z. FIG. 13 is a partially enlarged view of a wire harness 4 connected to a clamp 10 equipped with an O-ring 11. The clamp 10 is provided with the O-ring 11 in order to keep airtightness when the clamp 10 is attached to a camera case 3.

The clamp 10 includes a thread cutting portion 10*a* which permits the clamp 10 to be surely secured to a camera case 3, a hexagonal head 10*b* which is used when the clamp 10 is secured to the camera case by screw-tightening, and a flange 10*c* which generates tightening force between the clamp 10 and camera case 3 and facilitates the sealing function of the O ring.

The clamp 10 has an internal though-hole 10*d* through which electric wires such as cables 4*a*, and drain wire 4*a*' (hereinafter generally referred to as cables 4*a*, 4*a*') are to pass. As seen from FIG. 14, the cables 4*a*, 4*a*' are passed through the through-hole of the clamp 10 equipped with the O-ring 11. Terminals 5*p* are attached to the ends of the cables 4*a*, 4*a*', respectively.

After the cables 4*a*, 4*a*' have been passed through the through-hole 10*d* of the clamp 10, they are subjected to processing of potting. The potting is to pour soft rubber or soft resin such as epoxy polymer into a predetermined position to be sealed.

The potting permits the individual cables 4*a*, 4*a*' to be sealed completely so that entry of water, dust, etc. in the interior of the camera case or camera can be prevented. The sealing of the area subjected to the potting can be confirmed in terms of airtightness or watertightness due to moistening.

FIGS. 14 and 15 are perspective views each showing the assembly of camera modules Y and Z equipped with a conventional in-vehicle CCD camera. The camera module Y includes a camera 1 such as an in-vehicle CCD camera and a base plate 2 to which the camera 1 is attached. The camera module Z includes the camera module Y, a camera case 3 to which the camera module Y is attached and a wire harness 4 of various kinds of cables 4*a*, 4*a*' tied in a bundle.

FIGS. 14 and 15 show the process of assembling the conventional camera module. Specifically, FIG. 15 shows an inconvenience occurring when the camera module Y is mounted in the camera case 3. FIG. 16 shows a conceptual view of the section taken in line R—R in FIGS. 14 and 15 and connection of the wire harness 4, more specifically shows the state where the wire harness 4 is attached to the camera case 3 through the clamp 10.

Meanwhile, the CCD (charged coupled device) is a device for converting an optical signal such as an image into an electric signal using a semiconductor device which is reactive to light. The CCD is a semiconductor device developed in 1970 by Bell Telephone in USA. Generally, the image quality of the CCD depends on the number of pixels, which is set in a wide range of several hundred thousands to several millions. The number of pixels may be further increased in accordance with demands.

The CCD has been widely used in cameras such as a digital camera, video camera, etc. and copy machines such as facsimile, scanner, photocopying machine, laser beam printer, etc. In the case of the digital camera, the CCD is arranged in place of a silver film at a focal point. In recent years, the CCD having a large number of pixels has become inexpensive. This greatly contributes to low-price and high image quality of the digital camera.

A detailed explanation will be given of each of components of the conventional camera module Z. A camera 1 is composed of a lens 1*c* and a lens peripheral portion 1*d* for securing it. The camera 1 is attached to a base plate 2 which is mainly constructed of a base plate body 2'. Electric components such as connectors for electrical connection are installed on the base plate body 2'. The base plate body 2' is provided with a connector housing 2*c* related to the connector. Four through-holes 2*b* through which screws 13*b* are passed to secure the base plate 2 to a camera case 3 are made in the vicinity of four corners of the base plate body 2'.

The camera case 3 is constructed of a bottom wall 3*c* and side walls 3*d*, 3*d*' which encircle its four sides. A cylindrical projection 3*g*, which serves to secure the clamp 10 and seal the inside of the camera case 3, is attached to the side wall 3*d*'. Securing pieces 3*a* for securing the base plate 2 equipped with the camera 1 are provided at four corners of a chamber 3*e* of the camera case 3. A female hole 3*b* is made in each of the securing pieces 3*a*.

Now referring to FIG. 16, a detailed explanation will be given of the attaching state between the clamp 10 and camera case 3. A through-hole 3*f* through which a wire harness 4, i.e. a bundle of cables 4*a*, 4*a*' is passed is made in the side wall 3*d*' of the camera case 3. A female screw grove is formed on the inner peripheral face of the through-hole 3*f* so that it is screwed with a screwed portion 10*a* of the clamp 10, thereby surely securing the clamp 10.

The clamp 10 with the cables 4*a*, 4*a*' shown in FIG. 13 is fit in the through-hole 3*f*. The screwed portion 10*a* of the clamp 10 is engaged with the screwed through-hole of the camera case 3. Thus, the clamp 10 is secured to the camera case 3 as also shown in FIG. 16.

The cylindrical projection 3*g* keeps the airtightness by the O-ring 11 so that it serves as a shading plate for preventing entry of water and dust from the outside.

The wire harness 4 as shown in FIG. 16 connects the camera case 3 to a non-waterproof connector 5*r* located within a vehicle V. The drain cable 4*a*' branched from the middle portion of the wire harness 4 is provided with a terminal 5*s* which is a frame of a vehicle body B through a screw 13*c*. In this way, the drain wire 4*a*' serves as an earth.

As shown in FIGS. 14 and 15, the cable 4*a*', 4*a* and the camera 1 are electrically connector-connected in such a manner that a connector housing 5*q* with the cables 4*a*, 4*a*' connected therewith is fit in the connector housing 2*c*. In this way, the base plate 1 is electrically connected to the wire harness 4 and non-waterproof connector 5*r* located within the vehicle V and drain cable 4*a*'.

An explanation will be given of a typical method of assembling the in-vehicle CCD camera. First, the clamp 10 equipped with the O ring 11 is attached to the wire harness 4. The wire harness 4 is passed through the through-hole 10*d* of the clamp 10 so that the wire harness 4 and clamp 10 are provisionally fixed.

In the segment of the wire harness 4 which is to be entered into the camera case 3, a tube 4*d* which protectively covers the cables 4*a*, 4*a*' is cut up by a blade so that the cables 4*a*, 4*a*' are taken out from the tube 4*d*. A terminal 5*p* is attached to the end of each of the cables 4*a*, 4*a*'. The terminal 5*p* is accommodated within the connector housing 5*q* as shown in FIG. 14.

In order to improve the sealing degree between the wire harness and clamp 10, as shown in FIG. 13, the through-hole 10*d* of the clamp 10 is subjected to potting processing 12 that resin or rubber is poured into the through-hole 10*d*. Thus, the wire harness 4 and clamp 10 are secured to each other. The potting processing 12 as shown in FIGS. 13 and 16 improves the airtightness within the camera 3.

The operation of combining the wire harness 4 and the peripheral components thereof is generally referred to assembling the wire harness 4 and connector, or may be simply referred to "connector assy". In this case, in order that the camera case 3 is connected to the base plate 2, with the cables 4*a*, 4*a*' given a slight redundant length as seen from FIGS. 14 and 15, the clamp 10 is secured to the wire harness 4 at its prescribed position.

As shown in FIG. 16, the clamp 10 is attached to the through-hole 3*f* of the camera case 3. The threaded portion 10*a* of the clamp 10 is engaged with the through-hole 3*f*, i.e. female-threaded hole of the camera case 3 so that the clamp 10 is secured to the camera case 3 as shown in FIGS. 14 to 16. In this case, as seen from FIG. 16, the O-ring 11 and the potting processing 12 keep the airtightness or hermeticity of the inside of the camera case 3.

Thereafter, the base plate 2 with the camera 1, i.e. camera module Y is attached to the camera case 3 as follows. First, as shown in FIGS. 14 and 15, the connector component equipped with the connector housing 5*q* on the side of the wire harness 4 is connected to the connector component 2*c* attached to the base plate body 2'.

The camera module Y is attached to the camera case 3 as follows. The through-holes 2*b* of the base plate body 2' are aligned with the female threaded holes 3*b* of the camera case 3 at four corners.

The screws 13*b* are passed through the through-holes 2*b* of the base plate body 2' and screwed in them by a driver. Thus, the screws 13*b* are tightened into the female threaded holes 3*b* of the camera case 3. In this way, the camera module Y is secured to the camera case 3 to complete the camera module Z.

A connector wiring device as a related art is disclosed in J-UM-7-42075. J-UM-7-42075 mainly discloses an alignment holding mechanism for automatically aligning a plurality of paired cables without changing the order of their combinations in a line in a connector wiring device for automatically wiring the cores of the plurality of paired cables on a cover for provisionally fixing a connector.

However, as seen from FIGS. 14 and 15, in the conventional technique, the camera module Y was manually connected to the connector attached to the end of the cable 4*a*. Therefore, a worker was required to make a troublesome operation. Namely, with the cables 4*a*, 4*a*' arranged in the chamber 3*e* of the camera case and secured by the clamp 10, the assembling made by connecting the connectors provides poor workability.

Concretely, in the prior art, the through-hole 3*f* through which the cables 4*a*, 4*a*' are to be passed is formed in the camera case 3. The connector attached to the cables 4*a*, 4*a*' passed through the through-hole 3*f* is connected to another connector attached to the base plate 2. In assembling, therefore, the worker must make a troublesome operation.

In the conventional camera case 3, the through-hole 3*f* is threaded. In order to enhance the hermeticity, the operator must screw the clamp 10 into the through-hole 3*f* so that the clamp 10 equipped with the wire harness is installed in the camera case.

FIG. 15 is a perspective view for explaining an inconvenience when the camera module Y is combined with the camera case 3. Namely, as shown in FIG. 15, when the camera module Y is combined with the camera case 3, catching of the cables 4*a*, 4*a*' may occur.

SUMMARY OF THE INVENTION

An object of this invention is to provide an auxiliary machine module which can connect cables and a base plate while the base plate equipped with an auxiliary machine such as a camera and terminals such as caulking terminals is mounted in a case, thereby reducing the number of components arranged around the auxiliary machine.

Another object of this invention it to provide an auxiliary machine module which can prevent occurrence of catching of electric cables when the base plate equipped with the auxiliary machine such as a camera is mounted in the case.

Still another object of this invention is to provide an auxiliary machine module which can reduce the number of defective articles in connector-connection, and speed up and facilitate assembling.

A further object of this invention is to provide a method of manufacturing an auxiliary machine module which has the features described above.

In accordance with this invention, there is provided an auxiliary machine module comprising:

- an auxiliary machine;
- a base plate equipped with the auxiliary machine and a caulking connector;
- a case in which the base plate is mounted, and
- a connector means for electrically connecting the base plate and the case.

In this configuration, the auxiliary machine, base plate and case can be designed in a module so that the number of peripheral components can be reduced, and the module can be reduced in size and weight in a simplified structure. In addition, concurrently with mounting of the base plate in the case, electrical connection can be made therebetween.

Preferably, the base plate has a caulking connector composed of a first connector housing and caulking terminals and the case has a second connector housing in which electric wires are housed, and the connector means is formed when the base plate is attached to the case so that the caulking terminals are caulking-connected to the electric wires.

In this configuration, since caulking connection is made using the caulking terminals, the base plate and case can be electrically connected to each other when they are combined with each other.

Preferably, the first connector housing has a pair of guiding walls which are to be brought into sliding-contact with the second connector before the caulking terminals are caulking-connected to the wires, respectively.

In this configuration, when the base plate is combined with the case, the former can be lowered with no tilting towards the case.

Preferably, the guiding walls are longer than the caulking terminals and shorter than a height of the second connector housing.

In a configuration, the guiding walls serve as a guiding means more appropriately.

Preferably, the first connector housing has a pair of locking pieces and the second connector housing has a pair of engagement portions to be engaged with the pair of locking pieces.

In this configuration, the locking pieces can be fit in the engagement pieces so that the base plate can be coupled with the case easily, quickly and surely.

Preferably, the auxiliary machine is a camera attached to a motor vehicle so that the auxiliary machine module constitutes a camera module.

In this configuration, the camera, base plate and case can be designed in a module so that the number of peripheral components of the camera can be reduced, and the module can be reduced in size and weight in a simplified structure. In addition, concurrently with mounting of the base plate in the case, electrical connection can be made therebetween.

In accordance with this invention, there is provided a method of manufacturing an auxiliary machine module comprising the steps:

attaching an auxiliary machine to a base plate; and mounting the base plate in a case so that the base plate is electrically connected to the case by means of a connector means.

In a such a method, the auxiliary machine module can be assembled quickly and effectively.

Preferably, in the method of manufacturing the auxiliary machine module, the base plate has a caulking connector composed of a first connector housing and caulking terminals and the case has a second connector housing in which electric wires are housed, and the connector means is formed when the base plate is attached to the case so that the caulking terminals are caulking-connected to the electric wires.

In the method, using the caulking connector, the caulking terminals are caulking-connected to the wires on the case. Therefore, concurrently with assembling of the auxiliary machine module, the base plate can be electrically connected to the case.

In the method of manufacturing an auxiliary machine, the auxiliary machine is a camera attached to a motor vehicle so that the auxiliary machine module constitutes a camera module.

Therefore, even when the camera and its peripheral components malfunction, the camera module can be easily dismantled so that it can be removed from the motor vehicle, and easily inspected and repaired.

The above and other objects and features of the invention will be more apparent from the following description taken in conjunction with the accompanying drawings.

DESCRIPTION OF THE PREFERRED EMBODIMENTS

Figure 1:
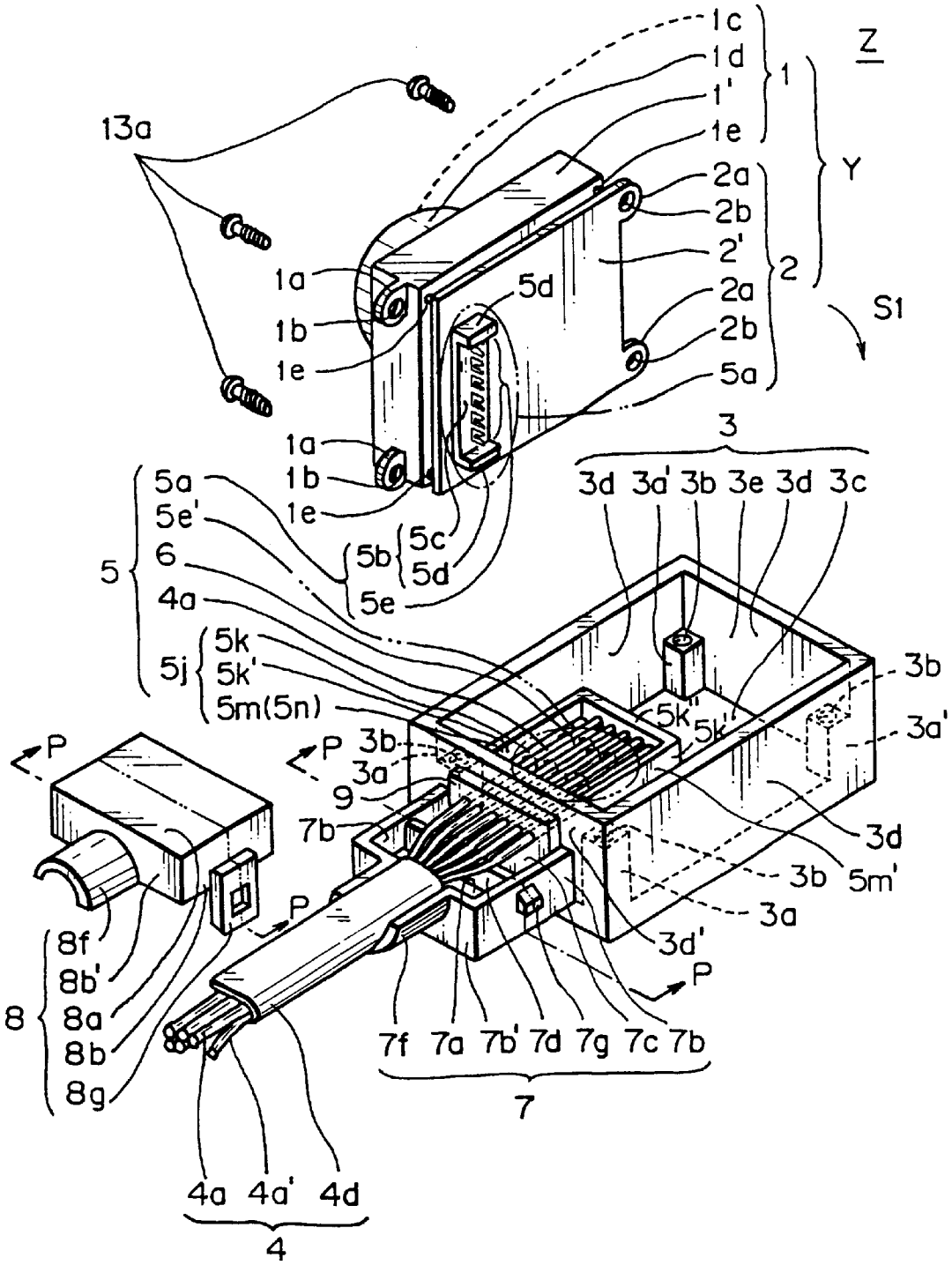
FIG. 1 is an exploded perspective view of an embodiment of an auxiliary module according to this invention.

Now referring to FIGS. 1 to 12, an explanation will be given of a camera module which is an example of an auxiliary machine module according to this invention. In FIGS. 1 to 12, like reference numerals refer to like elements in the conventional auxiliary machine module as described above.

Figure 2:
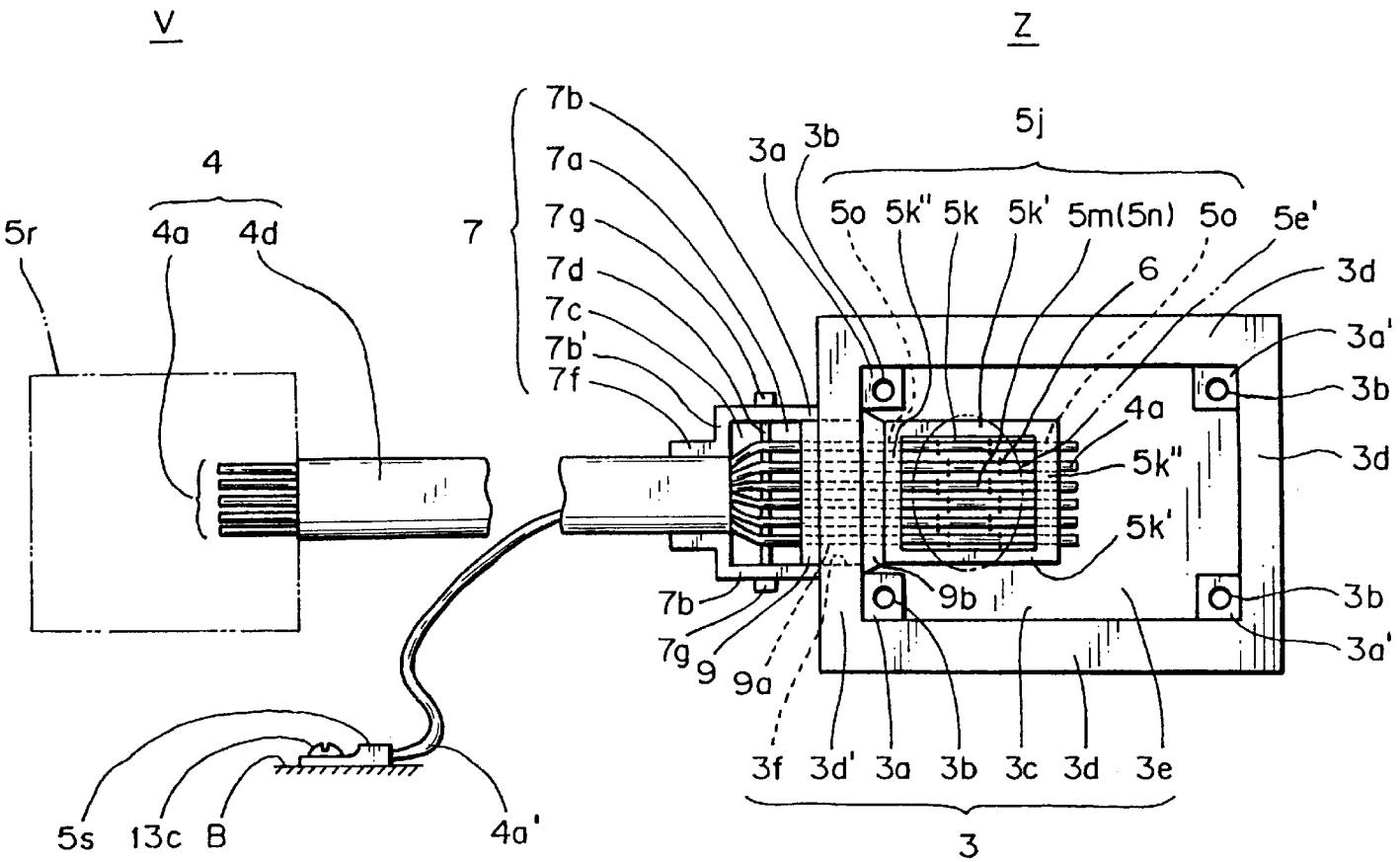
FIG. 2 is a conceptual view of the upper face of a case and connection of cables as shown in FIG. 1.
Figure 3:
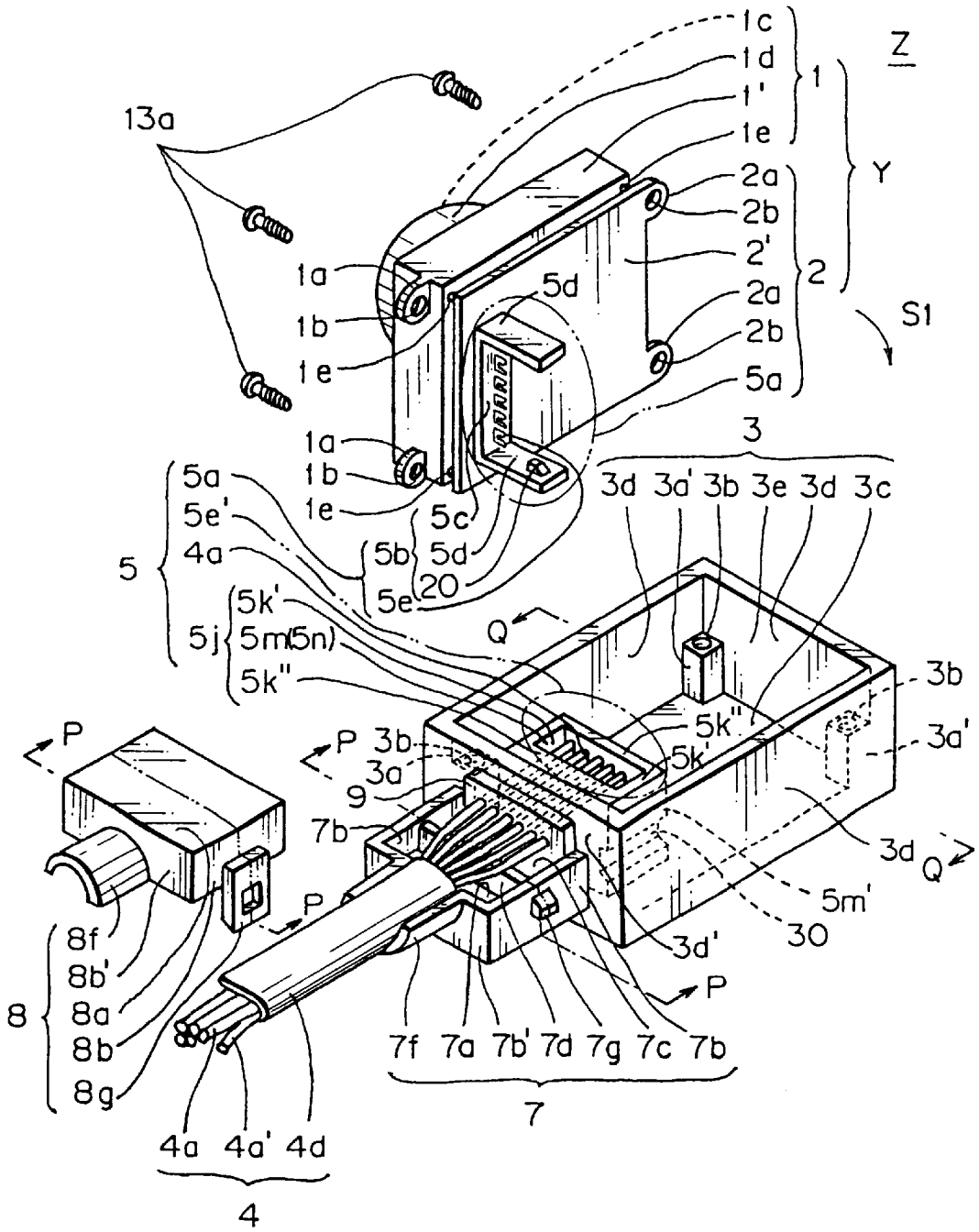
FIG. 3 is an exploded perspective view of another embodiment of an auxiliary module according to this invention.
Figure 4:
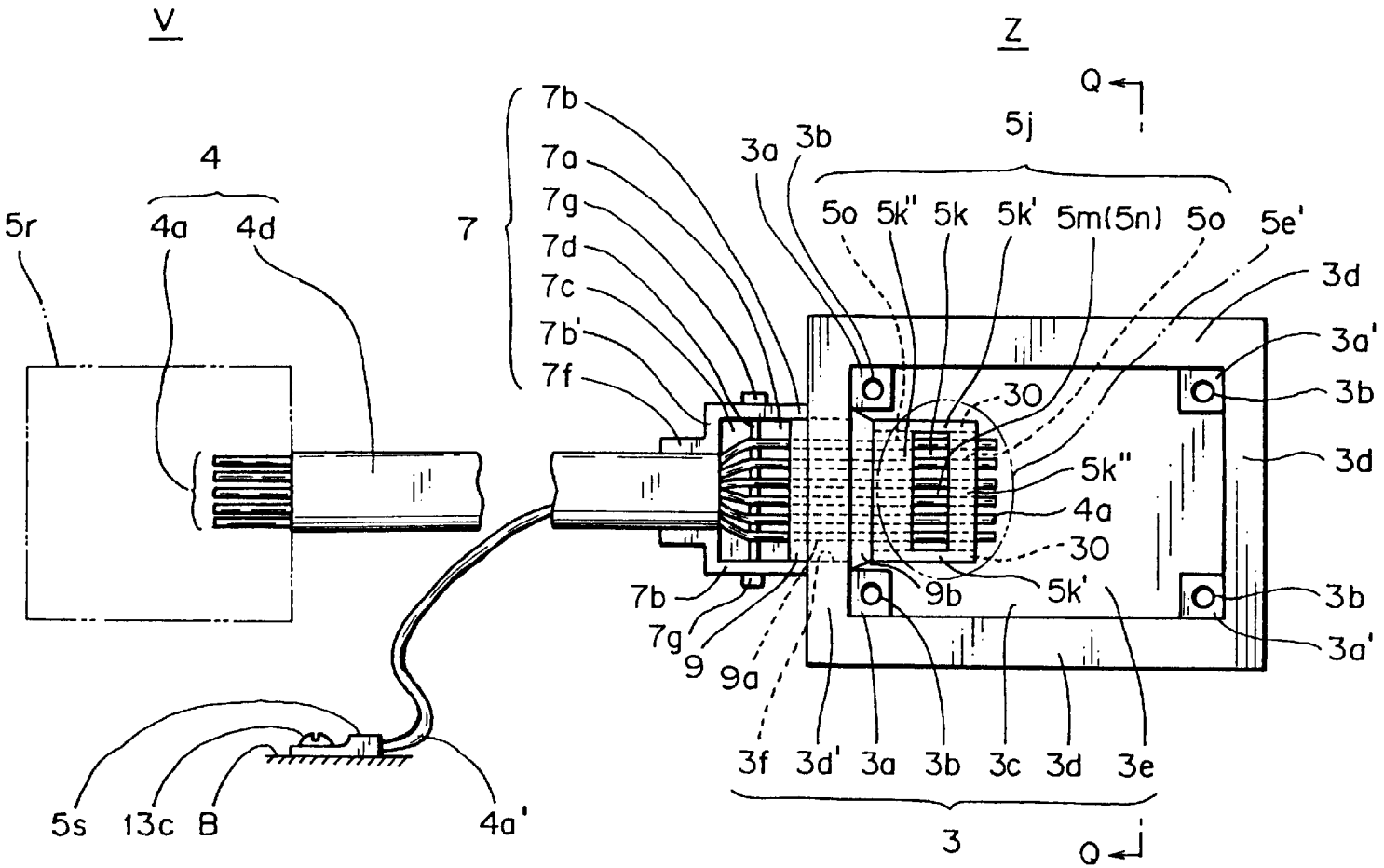
FIG. 4 is a conceptual view of the upper face of a case and connection of cables as shown in FIG. 3.
Figure 5:
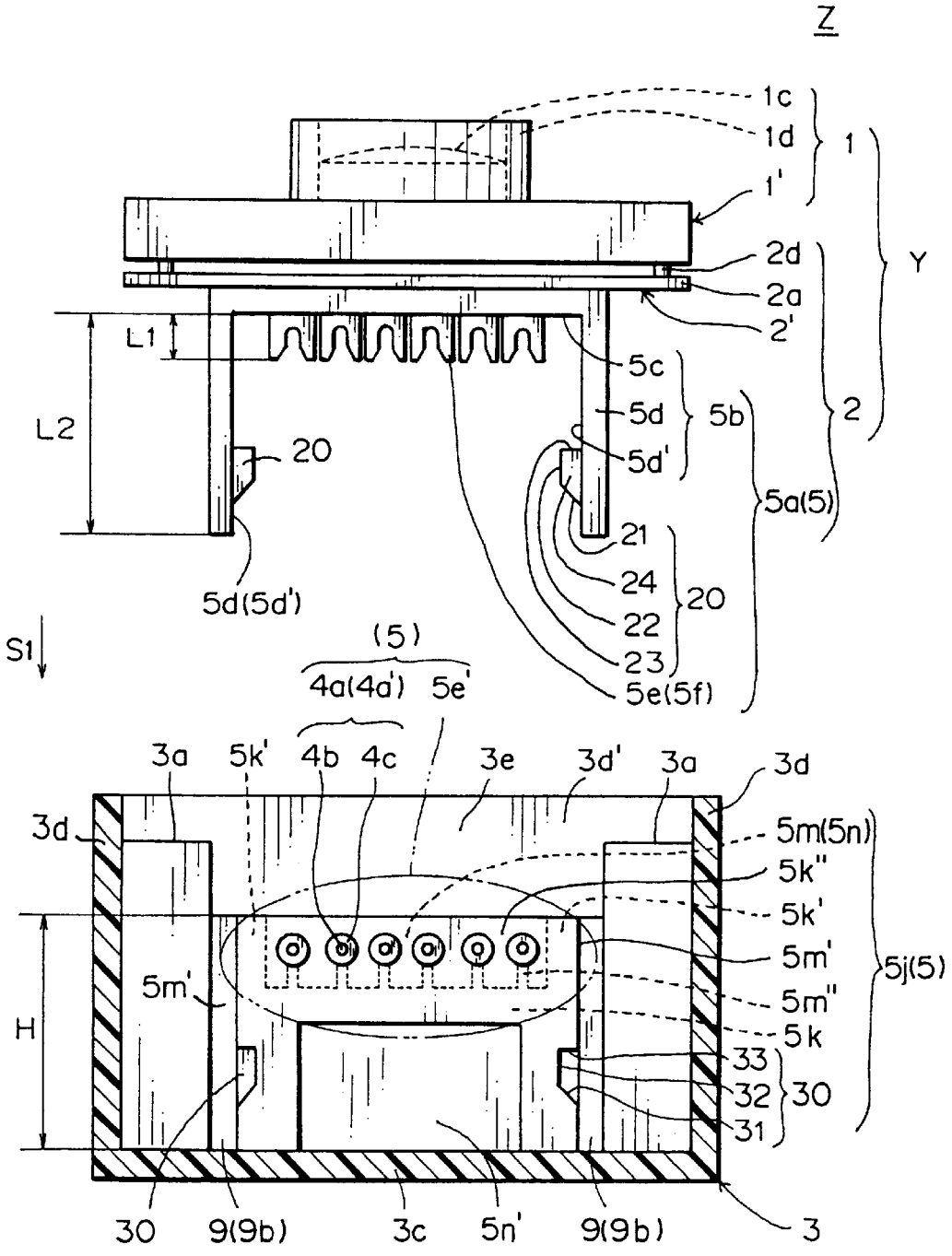
FIG. 5 is a sectional view taken in line Q—Q in FIG. 3, which explains attachment of a caulking connector to a connecting portion.

Referring to FIGS. 1, 3 and 5, in a vertical direction, an upper side refers to the side where the lens 1*c* of a camera module Z is located, whereas a lower side refers to a side where the bottom wall 3*c* of the camera case 3 is located. Referring to FIGS. 1 to 4, in a horizontal direction (back and forth), a front side refers to the side to which the cables constituting a wire harness are extended, whereas a rear side refers to the side opposite thereto.

Now, an assembly composed of at least two members, i.e. an auxiliary machine such as a camera 1 and a base plate 2 to which the camera 1 is attached is referred to as an auxiliary machine module, more concretely as a camera module Y. Further, an assembly composed of at least three members, i.e. the auxiliary machine such as the camera 1, base plate 2 to which the camera is attached and a camera case 3 to which the base plate 2 is attached is referred to as an auxiliary module z, more concretely as a camera module z.

The connector in this invention refers to a component for electric connection including members such as a terminal, electric wires, etc. The connector may be combined with packing, rubber stop, rear holder, etc. The connector incorporating a male terminal is generally referred to as a male connector, and the connector incorporating a female terminal is generally referred to as a female connector. In this invention, the component including at least a terminal and a connector housing is referred to as a "connector".

The electric wires in this invention generally include the wire harness 4, cable 4*a* or core wire inclusive of a drain wire 4*a*', or a conductor 4*b* with no coating. The cable 4*a*, 4*a*' in this invention is also referred to as a core wire, and may be a single conductor 4*b* or plural conductors 4*b* each covered with an insulating coating 4*c* or enamel material.

The camera used in this invention may be any camera such as a camera using CCD, MOS, etc. Now, the solid-state image pick-up device of CCD which can be typically used in this invention.

The CCD includes a photodiode (photosensitive element) transfer gate and an overflow drain. The CCD has a transfer system inclusive of a frame transfer, an interline transfer, etc. in a manner of taking out charges. The CCD is provided with a vertical transfer portion beside a photosensitive portion. A transfer gate is located between the transfer portion and the photosensitive portion. Such a CCD adopts a highly resistive substrate and is provided with a p type well beneath an n type layer of the vertical transfer portion so that photocharges generated at the inner part of the substrate are prevented from flowing into the transfer portion. This suppresses a smear phenomenon.

The solid-state image pick-up device of CCD densely incorporates a photosensitive portion, an overflow drain, a vertical/horizontal transfer portion, etc. on a Si substrate having a size of 10 mm square. About two hundred thousands to six millions of picture cells (pixels) are orderly arranged in a grid pattern. With respect to the number of picture cells, where 2000 pixels in row and 1500 pixels in column are arranged, the total number of pixels are 2000×1500=3000000 (three millions).

When an optical image of a subject body is focused on the surface of the substrate through a lens, photoelectrons the number of which corresponds to the brightness are generated in the respective pixels. Thus, the subject body is converted into an image of electrons. A large number of pixels are decomposed into horizontal scanning lines so that the photoelectrons will be taken out as a video signal.

Specifically, when a transfer pulse is applied to the photo-charges generated by incident light, the photoelectrons are simultaneously shifted to the vertical transfer CCD. When the transfer pulse is applied to the vertical transfer CCD, the charges are sequentially transferred from a pixel to another pixel in the CCD. They eventually reach the horizontal transfer CCD. This time, they are sequentially transferred for each of the horizontal scanning periods so that they are taken out as a signal from the output portion.

It has been demanded to increase the sensitivity of the CCD. However, as the case may be, a wide photosensitive area cannot be assured for this purpose. A proposal for overcoming such an inconvenience is to use a solid-state image pickup device in a double-layer structure in which high-sensitive elements such as target films of an image pick-up tube are stacked on the charge transfer portion. A future solid-state image pick-up device is expected to increase the sensitivity so as to be equal to that of the image pick-up tube, to increase the number of pixels to improve the resolution and reduce moiré, and further reduce an image size, thereby realizing high performance at low cost.

The MOS (metal-oxide-semiconductor) device which is mainly used as an integrated circuit has an advantage of low power consumption. The MOS type solid-state image pick-up device generates the optical charges corresponding to the intensity of incident light, and includes a large number of aligned pixels each composed of a photodiode having a function of temporarily storing the optical charges and a transistor serving as a switch for deriving the stored charges.

Referring to FIGS. 1 and 2, and FIGS. 3 and 4, an explanation will be given of the operation of assembling the camera module. Referring to FIGS. 5 to 12 also, the specific parts in FIGS. 1 to 4 are illustrated in an enlarged scale.

FIG. 1 is an exploded perspective view of an embodiment of a camera module as an auxiliary machine module Z according to this invention. FIG. 2 is a conceptual view of the upper face of a camera case 3 and connection of cables (wire harness) shown in FIG. 1.

FIG. 3 is an exploded perspective view of another embodiment of a camera module as an auxiliary module Z according to this invention. FIG. 4 is a conceptual view of the upper face of a camera case 3 and connection of cables (wire harness) shown in FIG. 3. FIG. 5 is a sectional view taken in line Q—Q in FIG. 3, which shows the state where the crimping connector 5*a* shown in FIG. 3 has been attached to the connection portion 5*e*' of the connector housing 5*j*. FIGS. 1 and 3 illustrate the state where the camera module Y composed of the camera 1 equipped with CCD and base plate 2 attached to it and case cover 8 are to be attached to prescribed positions of the camera case 3.

As seen from FIGS. 1, 3 and 5, the camera module Z includes at least the camera 1 equipped with the CCD, base plate 2 having caulking terminals 5*e* on which the camera 1 is attached, and a camera case 3 in which the base plate 2 is mounted. The base plate 2 is mounted in the camera case 3 along a mounting direction so that the caulking terminals 5*e* of the base plate 2 and the connecting portion 5*e*' are electrically connected to each other to constitute a connector 5.

In this way, the camera 1, base plate 2 and camera case 3 are configured as a module, and the number of the peripheral components can be reduced. The camera module Z is reduced in size and weight, and the assembling structure thereof can be simplified. Since the base plate 2 is installed on the camera case, the assembling and electrical connection therebetween can be simultaneously realized.

Figure 15:
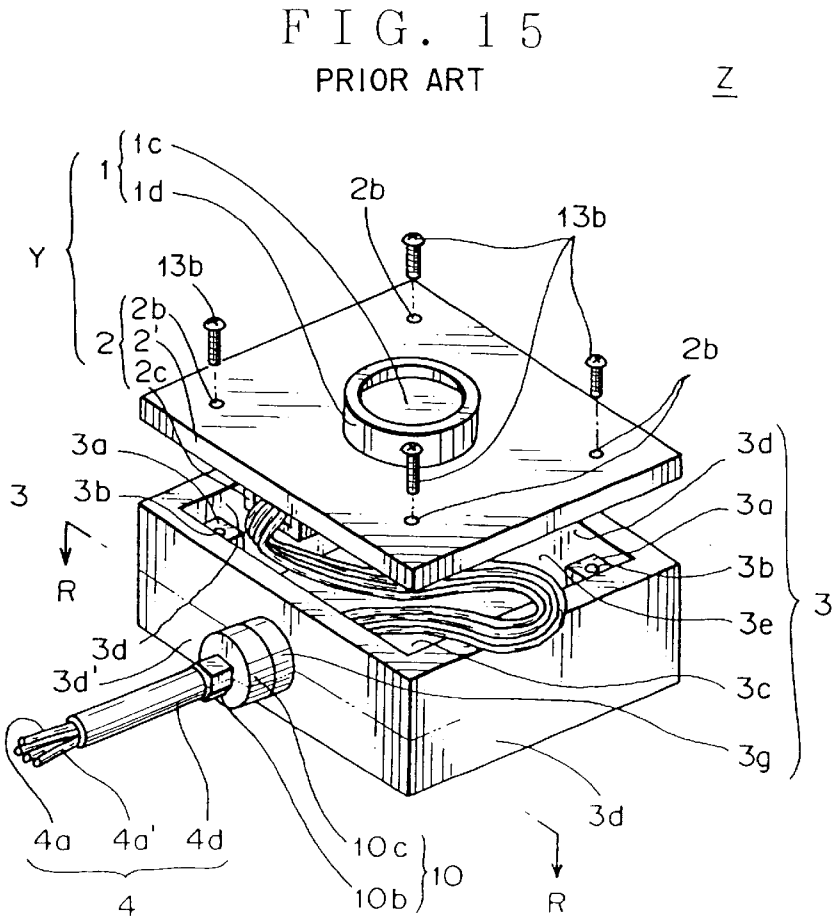
FIG. 15 PRIOR ART
FIG. 15 is a perspective view of the inconvenient state when the camera module is assembled with the camera case.

The inconvenience that might occur in assembling the conventional camera module Z as shown in FIG. 15 can be removed. Specifically, conventionally, when the base plate 2 to which the camera is attached is mounted in the camera case 3, the cables 4*a*, 4*a*' might be caught between the base plate 2 and camera case 3.

There was a fear of internal breakage of the cables 4*a*, 4*a*'. Therefore, the camera module Z which provide such fear must be dealt with as an inferior good. There was a fear of poor electrical contact owing to breakage of the cables 4*a*, 4*a*'.

Discarding such a semi-finished products is not preferred from the standpoint of environmental friendliness, and come to nothing in production. Therefore, there was also necessity of assembling the camera module by replacement of the wire harness 4 and the clamp 10 relative to it. However, in accordance with this invention, the above inconvenience in assembling the camera module can be removed without executing such a troublesome operation.

A detailed explanation will be given of the respective parts shown in FIGS. 1, 3 and 5. The camera 1 is composed of a camera body 1 equipped with CCD, screw-fastening portion 1*a*, screw-fastening holes 1*b*, lens 1*c*, lens peripheral portion 1*d* and positioning holes 1*e*, etc. In order to position/secure the camera body 1' and a base plate body 2' precisely, the positioning holes 1*e* are made at the four corners in the camera body 1'. Projections 2*d* for positioning are formed on the rear side of the base plate body 2' as shown in FIG. 1 so as to correspond to the positioning holes 1*e*.

As seen from FIG. 5, the base plate body 2' is equipped with screw-fastening portions 2*a* and projections 2*d*. The projections 2*d* made at the four corners of the base plate 2 are fit in the positioning holes 1*e* at the four corners of the camera body 1' so that the camera 1 and base plate 2 are combined accurately.

As seen from FIGS. 1, 3 and 5, the base plate 2 is equipped with a caulking connector 5*a* on the lower face thereof. The caulking connector 5*a* includes a connector housing 5*b* and caulking terminals 5*e*. The connector housing 5*b* is composed of a top wall 5*c* and a pair of guiding walls provided on both ends thereof. The caulking connector 5*a* is located to a prescribed position of a base plate body 2' and is formed as a part of the base plate 2.

The caulking connector 5*a* is composed of six crimping terminals 5*e* and a connector housing 5*b*. The caulking terminals 5*e* each having a prescribed length L1 are aligned at regular intervals on the top wall 5*c* of the connector housing 5*b*.

Figure 7:
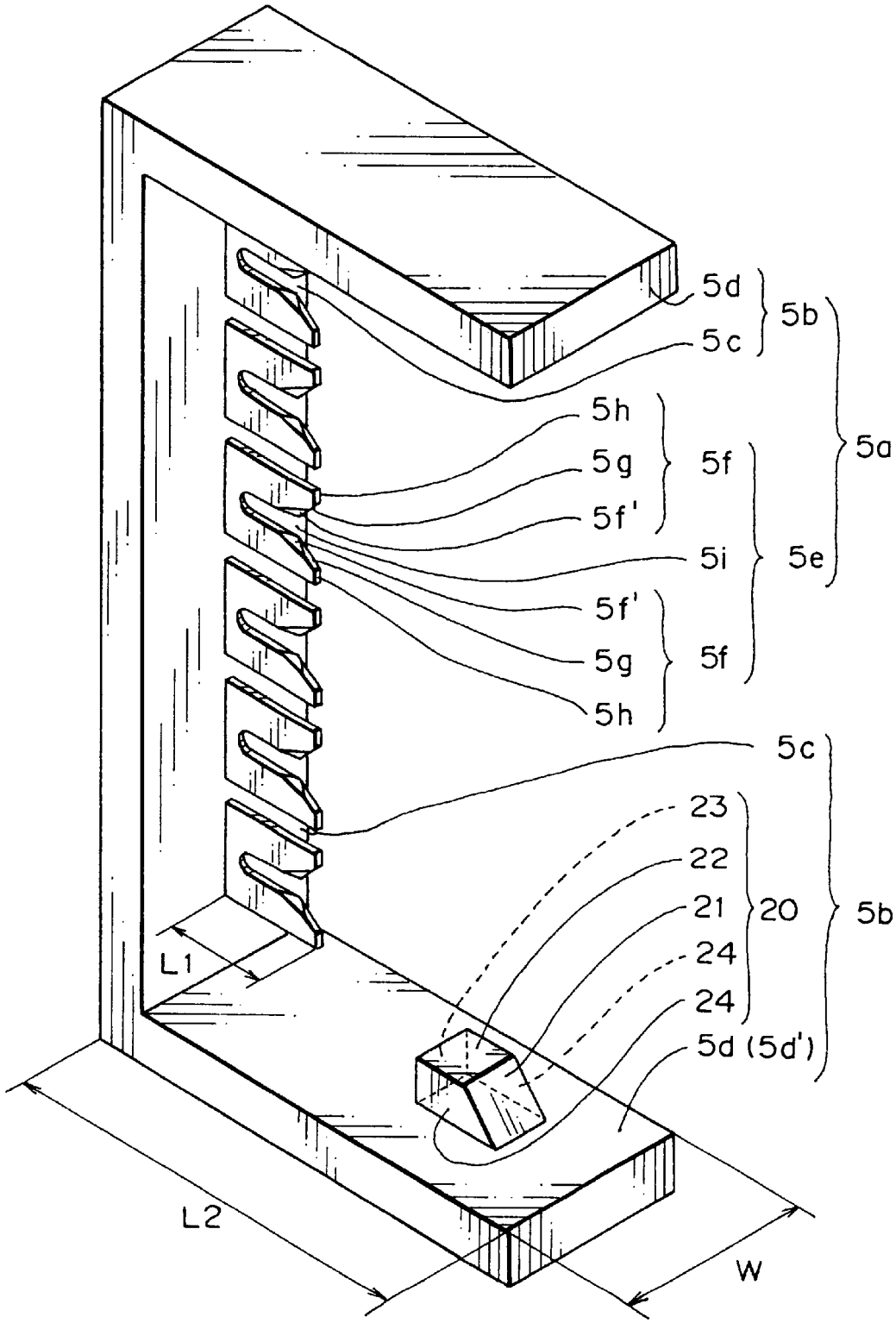
FIG. 7 is an enlarged perspective view of the caulking connector as shown in FIG. 3.

As seen from FIGS. 3, 5 and 7, the pair of guiding walls 5*d* of the connector housing 5*b*, each is provided with a securing piece 20. The pair of guiding walls 5*d* each has a length L2 from the plane to which the caulking terminals 5*e* are attached to its tip.

Referring to FIGS. 5 and 7, an explanation will be given of the securing piece 20. As clearly seen from FIG. 7, the securing pieces 20 are protruded from the opposite inner faces 5*d'* of the pair of guiding walls 5*d*. This securing piece 20 is centrally of the width W of the guiding walls 5*d*, i.e. connector housing 5*b*.

As seen from FIGS. 5 and 7, the securing piece 20 is composed of an inclined face 21, a parallel face 22, vertical face 23 and a side face 24. The inclined face 21 is a slope which goes towards the interior of the ⊐-shaped caulking connector 5*a* and toward the caulking terminals 5*e*.

The parallel face 22 is in parallel to the inner faces 5*d'* of the pair of guiding walls 5*d* and located more internally of the caulking connector 5*a* than the inner faces 5*d'*. The vertical face 23 is perpendicular to the inner faces 5*d'* and to the parallel face 22, and also in parallel to the plane on which the caulking terminals 5*e* are located.

The pair of side faces 24 are located on both sides of the inclined face 21, parallel face 22 and vertical face 23 so that they are perpendicular to the inner faces 5*d'*. As seen from FIG. 7, the distance between the side faces 24, i.e. the width of the securing piece 20 is more narrow than the width W of the guiding wall 5*d*. Such a securing piece 20 may be called a beak.

As seen from FIGS. 1 to 5, a connector housing 5*j* is installed within a chamber 3*e* of the camera case 3. The cables 4*a*, 4*a'* are aligned at regular intervals within a chamber 5*m* of the connector housing 5*j*. A plurality of supporting portions 5*m"* for supporting the cables 4*a*, 4*a'* are provided so as to correspond to the caulking terminals 5*e* from the bottom wall 5*k* of the connector housing 5*j* on the side of the camera case 3 to an opening 5*n* of the connector housing 5*j*.

As seen from FIG. 5, the supporting portions 5*m"* are aligned within the chamber 5*m* of the connector housing 5*j* so as to correspond to through-holes 5*o* made on the side wall 5*k"* of the connector housing 5*j* shown in FIG. 4. The cables 4*a*, 4*a'* are supported by the supporting portions 5*m"*. The connector housing 5*j* is installed within the chamber 3*e* of the camera case 3 so as to have a height H from the bottom wall 3*c* of the camera case 3 to the end face of the opening 5*n*.

As seen from FIGS. 3 to 5, a pair of engagement pieces 30 which correspond to the pair of securing pieces 20 are attached to the outer faces 5*m'* of the connector housing 5*j*. The pair of engagement pieces 30, as seen from FIG. 5, are located in the vicinity of the lower part at a height of about ½ or less of the height H of the connector housing 5*j* from the bottom wall 3*c* of the camera case 3*c*.

A parallel face 32 is formed more internally of the connector housing 5*j* than and in substantially parallel to the outer face 5*m'* of the side wall 5*k'* of the connector housing 5. A vertical face 33 is formed to be perpendicular to the outer face 5*m'* and the parallel face 32 and in parallel to the inner face of the bottom wall 3*c* of the camera case 3. Such engagement portions 30 may be called simply grooves.

The securing pieces 20, i.e. beaks are fit in the engagement pieces 30, i.e. grooves so that the camera module Y equipped with the caulking connector 5*a* can be coupled with the camera case 3 equipped with the connector housing 5*j* easily, quickly and surely.

Figure 6:
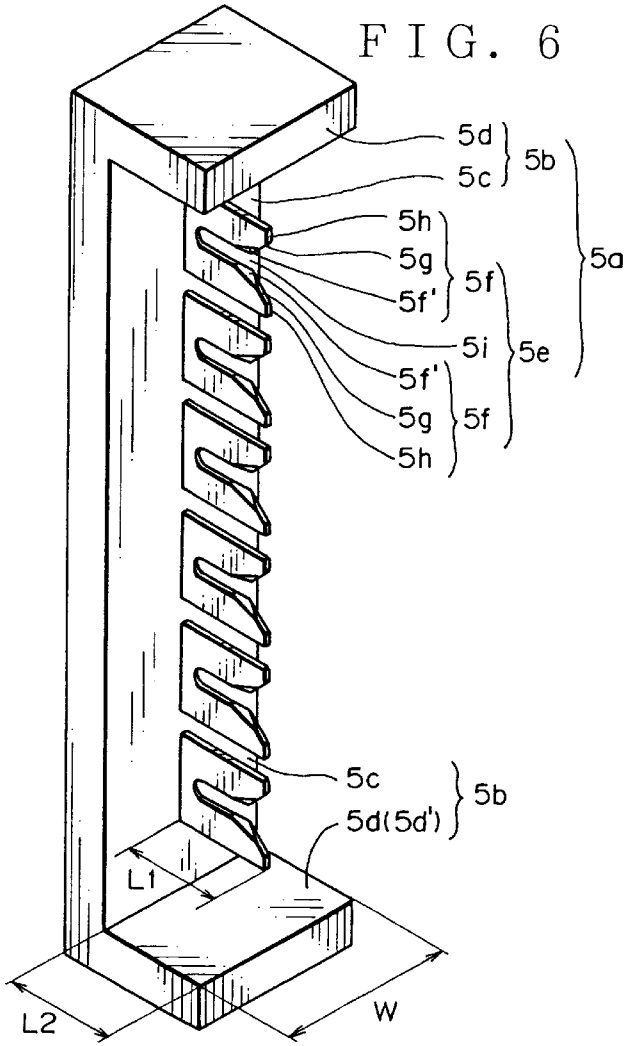
FIG. 6 is an enlarged perspective view of the caulking connector as shown in FIG. 1.

FIG. 6 is an enlarged perspective view of the caulking connector 5*a* shown in FIG. 1, and FIG. 7 is an enlarged perspective view of the caulking connector 5*a* shown in FIG. 3. The caulking connector 5*a* is composed of caulking terminals 5*e* each having blades 5*f* and the connector housing 5*b*. The caulking connector 5*a* is built in the base plate 2. The caulking terminals 5*e* are connected to various electric circuits provided on the base plate body 2'.

Six caulking terminals 5*e* are attached to the top wall 5*c* of the caulking connector 5*a* so that they are aligned in parallel at regular intervals. These caulking terminals 5*e* are located centrally for the width W of the connector housing 5*b*. These caulking terminals 5*e* each has a prescribed length L1 from the plane of the top wall 5*c* to the end 5*h* of the caulking terminal 5*e*.

The connector housing 5*b* of the crimping connector 5*a* includes the top wall 5*c* and a pair of guiding walls 5*d* on both ends thereof, and formed in a ⊐-shape to have an uniform width W.

The pair of guiding walls 5*d* have opposite inner faces 5*d'* which are perpendicular to the plane of the top wall 5*c*. These inner faces 5*d'* are slidably kept in contact with the outer faces 5*m'* of the connector housing 5*j* on the side of the camera case 3 shown in FIGS. 1, 3 and 5.

Figure 8:
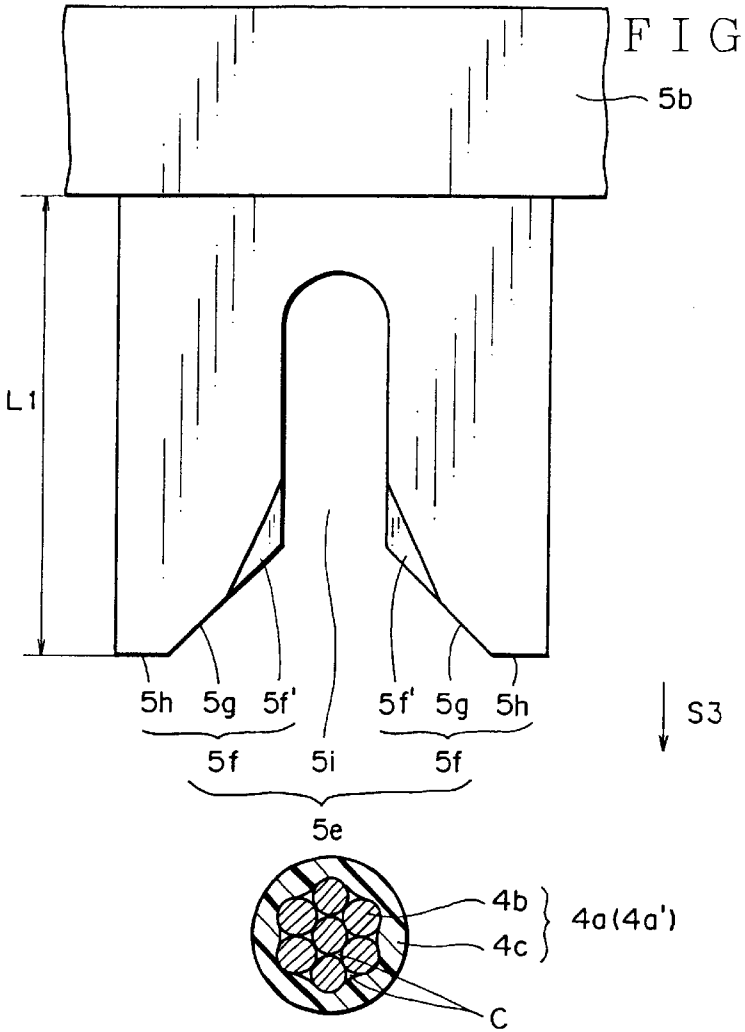
FIG. 8 is an enlarged view showing the state immediately before the caulking-connection between the caulking terminal as shown in FIGS. 1, 3 and 5 and cables.
Figure 10:
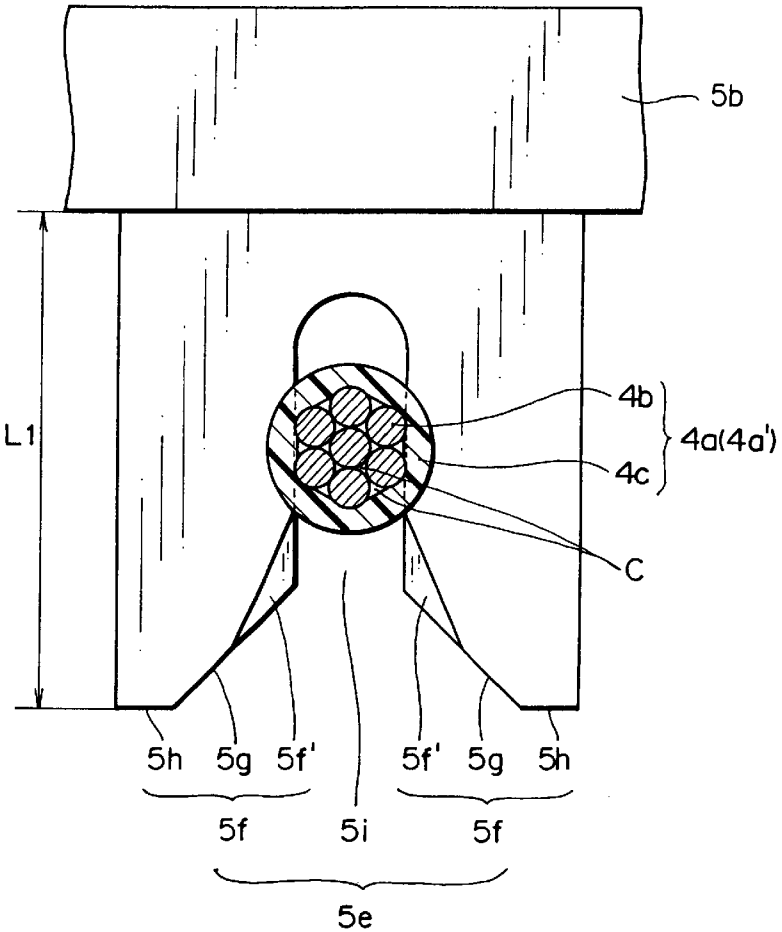
FIG. 10 is an enlarged view showing the state after the caulking-connection between the caulking terminal and cables as shown in FIG. 9 has been completed.
Figure 9:
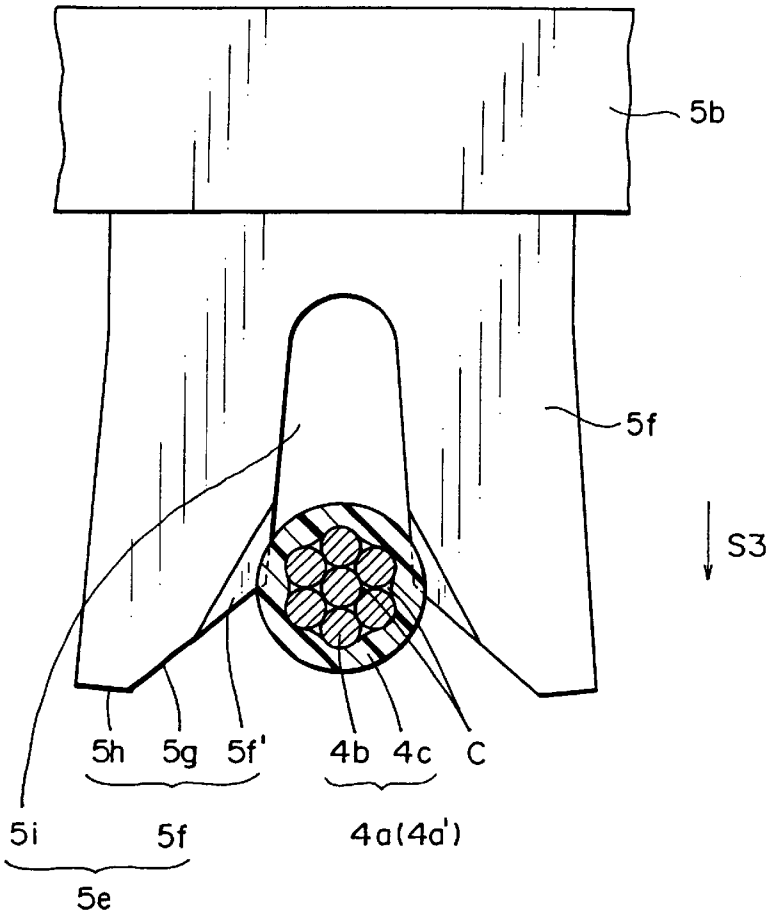
FIG. 9 is an enlarged view showing the state after the caulking-connection between the caulking terminal and cables as shown in FIG. 8 has been started.

FIG. 8 is an enlarged view showing the state immediately before the caulking-connection between the caulking terminals shown in FIGS. 1, 3 and 5 and the cable 4*a*, 4*a'* is started. In FIG. 8, the crimping terminal 5*e* is illustrated in an enlarged manner from that in FIGS. 6 and 7. FIG. 9 is an enlarged view of the state where the crimping-connection between the crimping terminal 5*e* and the cable 4*a*, 4*a'* has been just started along a direction of arrow S. FIG. 10 is an enlarged view of the state where the caulking-connection between the caulking terminal 5*e* and the cable 4*a*, 4*a'* has been completed along a direction of arrow S.

As seen from FIGS. 8 to 10, the cable 4*a*, 4*a'* is a core wire composed of a plurality of conductors 4*b* and an insulating coating or tube 4*c*. There is slight gaps C among the conductors 4*b*. The insulating coating 4*c* and tube 4*d* of the cable 4*a*, 4*a'* used in this invention may be made of e.g. soft resin or rubber, etc. The wire or wire harness 4, which is composed of the cables 4*a*, 4*a'* and tube 4*d*, can be bent as necessary.

The conductor 4*b* is preferably made from a metallic wire which has good conductivity and a performance enough to endure repetitive bending. In this invention, the plurality of conductors 4*b* are bundled and twisted properly to provide the core wire having excellent strength. In order to increase the insulation property of the surface of the conductor 4*b* of the metallic wire, the conductor 4*b* coated with an enamel may be used for the wire harness 4.

The insulating coating 4*c* is preferably made from an insulating material which has a performance enough to endure repetitive bending. Such an insulating material includes synthetic resin, soft resin, rubber, or an admixture thereof.

Referring to FIGS. 1, 3 and 5, a detailed explanation will be given of the structure of the camera module Z. The caulking terminals 5*e* are integrally formed so as to be aligned on the top wall 5*c*. The caulking terminal connector 5*a* equipped with the caulking terminals 5*e* is located on a prescribed position of the base plate 2.

The connector housing 5*j* is installed in the chamber 3*e* of the camera case 3. The cables 4*a*, 4*a*' are aligned within the connector housing 5*j* to provide a connecting portion 5*e*'. The base plate 2 equipped with the camera 1 is fit in the camera case 3 along the direction of arrow S1 so that the caulking terminal 5*e* is caulked with the cable 4*a*, 4*a* to provide a connector 5.

Figure 14:
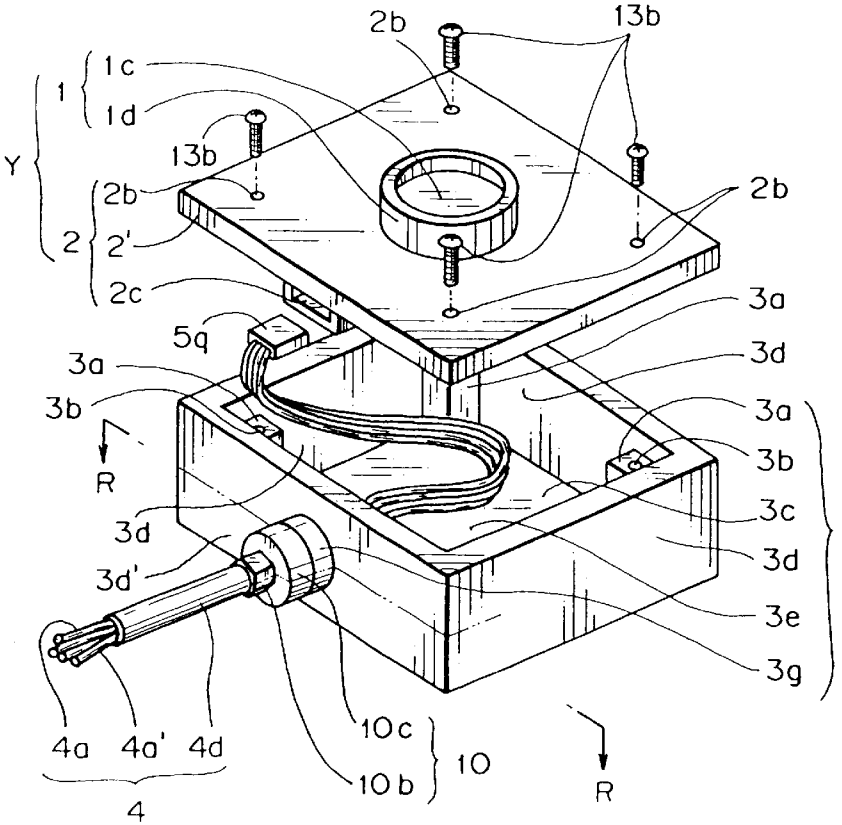
FIG. 14 PRIOR ART
FIG. 14 is a perspective view of the state when a conventional camera module is assembled.

In this way, the caulking-connection using the caulking terminal 5*e* permits an electrical connection to be easily realized in assembling. Unlike the structure as shown in FIGS. 14 and 15 in which the connector housing 5*q* attached to the cables 4*a*, 4*b* is connected to the connector housing 2*c* attached to the base plate body 2' to provide a connector, in accordance with this invention, as shown in FIGS. 1 and 3, the base plate 2 equipped with the caulking terminals 5*e* is coupled with the camera case 3 so that the base plate 2 and camera case 3 are electrically connected through the connector 5. Such a structure can be easily disassembled and is suitable to reduce the industrial waste which badly influences on the terrestrial environment.

Referring to FIGS. 6 to 8, a detailed explanation will be given of the shape of each of the caulking terminals 5*e*. The caulking terminal 5*e* is composed of a pair of caulking blades 5*f* having their opposite slopes 5*g* and arranged in parallel. Specifically, the caulking blades 5*f* have a pair of slopes 5*g* where the cable 4*a*, 4*a*' start to enter. The slopes constitute sharp blade bodies 5*f*'.

The caulking terminal 5*e* has a caulking slit 5*i* in the vicinity of its vertical center line. The slit serves to permit the cable 4*a*, 4*a*' to enter, and has a size which is more narrow than the diameter of the cable 4*a*, 4*a*' and does not injure or break excessively the conductors 4*b* tied in a bundle. The caulking slit 5*i* is formed in a U-shape. Incidentally, the caulking terminal 5*e* maybe formed in another shape.

For example, the end 5*h* of the caulking terminal 5*e* is provided so that an operator's arm is not inadvertently injured by the sharp end of the caulking blade when the camera 1 and base plate 2 are combined to manufacture the camera module Y or the camera module is accommodated in the camera module. However, the end 5*h* may have a sharp tip according to the size or shape of the caulking terminal and portion where the caulking terminal is used.

Such a caulking terminal 5*e* is used for electric connection to the conductor 4*b* such as a core wire coated with an insulating coating 4*c* such as resin, rubber, composite material or enamel material. By caulking the crimping terminals 5*e* with the cables 4*a*, 4*a*' each composed of a plurality of conductors 4*b* coated with the insulating coating 4*c*, the removal of the insulating coating 4*c* of the cable 4*a*, 4*a*' and electrical connection of the conductor 4*b* thereof are simultaneously effected.

Now referring to FIGS. 9 and 10, a detailed explanation will be given of the operation of caulking the conductors 4*b* of the cable 4*a*, 4*a*' into the caulking slit 5*i* of the crimping terminal 5*e* through the crimping blades 5*f* as shown in FIG. 8. As shown in FIG. 8, the operation of caulking the caulking terminal 5*e* in an appropriate orientation over the cable 4*a*, 4*a*' is started in an attaching direction S3.

First, caulking of the caulking blades 5*f* of the caulking terminal 5*e* for the cable 4*a*, 4*a*' coated with the insulating coating 4*c* is started. Then, as seen from FIG. 9, the sharp slope 5*g*, i.e. 5*f*' of the sharp terminal 5*e* starts to tear the insulating coating 4*c* of resin or rubber of the cable 4*a*, 4*a*', or of an thin enamel film covering the periphery of the conductors 4*b*. At this time, a pair of caulking blades 5*f* which constitute the caulking terminal 5*e* is opened so that the caulking slit 5*i* is slightly enlarged.

As the caulking proceeds, the caulking slit 5*i* formed centrally of the caulking terminal 5*e* is brought into contact with the internal conductors 4*b* of the cable 4*a*, 4*a*' while tearing the insulating coating 4*c*, which results in a state as shown in FIG. 10. In this way, the caulking terminal 5*e* can simultaneously carry out the removal of the insulating coating 4*c* and the connection of the conductors 4*b*.

Thus, the caulking terminal 5*e* provided with the caulking blades 5*f* is brought into contact with the internal conductors 4*b* of the cable 4*a*, 4*a*, or conductor 4*b* coated with the enamel material, which results in a conducting state. Specifically, the caulking blades 5*f* of the caulking terminal 5*e* have only to be crimped on a prescribed portion of the conductor 4*b* to provide a conducting state.

Now, an explanation will be given of the terminal itself. The terminal can be classified into a caulking terminal and a crimping terminal. As described in connection with FIG. 10, the caulking terminal 5*e* is used to caulk the cable 4*a*, 4*a*' with the conductor 4*b* coated with the coating 4*c* by the blades 5*f*' of the caulking blades 5*f* of the caulking terminal 5*e*. In this case, the removal and insulating coating 4*c* and connection of the conductors 4*b* are simultaneously carried out. A typical example thereof is a terminal equipped with a U contact having the caulking slit 5*i* (simply referred as "slit").

On the other hand, the caulking terminal is a terminal which is used to make the mechanical and electrical connection of an electric wire with the aid of a barrel which is plastically deformed using a crimping tool. Generally, the barrel includes a wire barrel for crimping a conductor portion of a wire except the portion coated with an insulating material and an insulation barrel for crimping the insulated portion of the wire. The wire barrel is classified into a closed barrel and an open barrel.

For example, in this invention, the caulking connector 5*a* may be replaced by a male connector or female connector incorporating the crimping terminal while the part including the cables 4*a*, 4*a*' within the connector housing 5*j* may be replaced by the female connector or male connector in which a complementary terminal is housed.

The part of the cable 4*a*, 4*a*' housed in the connector housing 5*j* may be made of a bus bar. The end of the bus bar may be formed in a prescribed terminal shape so that it can be connected to a connector component formed on the base plate. The terminal and connector in any format may be adopted as long as they do not injure the object of this invention.

Various kinds of electric components such as the bus bar, terminal and electric wire to be connected to each of the electric wirings are held in the base plate body 2' shown in FIGS. 1 and 3. The base plate 2 is used to hold the various kinds of electric components and has a function of insulation to prevent poor electric contact from occurring among the various kinds of electric components. Such a base plate 2 can be referred to as an insulating plate.

The material of the base plate will be explained below. The material is preferably synthetic resin such as thermosetting resin or thermoplastic resin because it has excellent formability and can satisfactorily insulate various electric components such as bus bars, terminals, etc. For example, any synthetic resin with low water absorbing property can be used because of its size stability, mass productivity, stable electric performance, etc.

The bus bar is a conductive plate which is branched into a plurality of electric circuits with a large number of electric contacts, thereby providing an electric circuit network. The bus bar can include a bus bar body, connector bus bar, fuse bus bar, power source bus bar, etc. The fuse bus bar is also called a fork-type terminal. The bus bar may be provided with a relay terminal as occasion arises.

The caulking terminal 5*e* or bus bar used in this invention is made of e.g. copper material such as bronze and copper alloy, aluminum alloy, etc. However, the caulking terminal 5*e* or bus bar may be made of any material as long as it is a metal or conductor capable of passing a current.

The above material may be subjected to surface protection treatment such as plating in order to improve corrosion resistance. However, if it can sufficiently maintain the performance under a normal condition, such surface protection treatment should be omitted in view of the production cost.

As shown in FIGS. 1, 3 and 5, before the caulking terminal 5*e* is caulked with the cable 4*a*, 4*a*', a pair of guiding walls 5*d* are formed so that they can be brought into slidable contact with the outer faces 5*m*' of the side walls 5*k*' of the connector housing 5*j*.

In this way, the pair of guiding walls 5*d* serve as a guide in slidable contact with the connector housing 5*j* on the side of the camera case 3. In this way, as shown in FIG. 5, when the base plate 2 equipped with the camera 1 and caulking connector 5*a* is assembled with the camera case 3, the camera module Y is lowered toward the connector housing 5*j* on the camera case 3 in an proper posture without so great tilting. Thus, the camera module Y will be appropriately combined with the camera case 3.

After the camera module Y has been fallen in such a posture, the connector housing 5*b* will be coupled with the connector housing 5*j* on the side of the camera case 3. Therefore, the caulking terminals 5*e* attached to the caulking connector 5*a* will be connected to the cables 4*a*, 4*a*' at right angles, respectively.

Thus, as shown in FIG. 10, the internal conductors 4*b* of the cable 4*a*, 4*a*' can be surely brought into contact with the caulking slit 5*i*, thus preventing malfunction such as poor electric contact from occurring.

Now, the word "right angle" refers to the state that the direction of extending the wires such as the cables 4*a*, 4*a*' is orthogonal to the planar portion of each of the plate-like caulking terminals 5*e* each with a pair of caulking blades 5*f* arranged in parallel.

If the caulking blades 5*f* and the cables 4*a*, 4*a*' are connected in their tilted state, undue force is applied to the caulking terminal 5*e* so that the caulking blades 5*f* thereof may be deformed.

If the caulking blade 5*f* are deformed, the caulking slit 5*i* may not be surely brought into contact with the internal conductors 4*b*. In this state, poor electric contact will occur. This invention can avoid such malfunction.

As shown in FIG. 5, the length L2 of the pair of guiding portions 5*d* is longer than the length L1 of the caulking terminal 5*e* and shorter than the height H of the connector housing 5*j* provided within the chamber 3*e*.

The direction of the lengths L1, L2 and the height H is that when the camera module Y is lowered directly below it in the proper posture with no tilt, i.e. the vertical direction of the camera module Z.

In this way, the above malfunction is more difficult to occur. The pair of guiding portions 5*d* serve as guides more satisfactorily as their length L2 increases. To this end, the guiding portions 5*d* must be brought into slidable contact with the outer surface 5*m*' of the connector housing 5*j* before the connection between the caulking terminal 5*e* and the cable 4*a*, 4*a*' is started.

Since the length L2 of the pair of guiding portions 5*d* is longer than the length L1 of the caulking terminal 5*e*, the former can serve as the guides before the connection between the caulking terminal 5*e* and the cable 4*a*, 4*a*' is started.

Since the pair of guiding portions 5*d* serve as the guide more satisfactorily as its length L2 is longer, the length L2 is preferably longer than ⅓ of the height H of the connector housing 5*j*, more preferably, longer than ½.

In order that the caulking connectors 5*a* are housed in the chamber 3*e* of the camera case 3, the length L2 must be shorter than the height H of the connector housing 5*j*. It should be noted that to increase the length L2 excessively makes it difficult to handle the caulking connector 5*a* and does not contribute to reduction of size/weight.

If the width W of the pair of guiding portions is also determined appropriately in proportion to the length L2, the stability of the guiding portions 5*d* is improved so that they can use its function more satisfactorily.

In this way, the caulking terminals 5*e* can be caulked with the cables 4*a*, 4*a*', with the caulking blades 5*f* being perpendicular to the cables 4*a*, 4*a*', relatively to the bottom wall 5*k* of the connector housing 5*j* and side wall 5*k*' thereof in parallel to the cables 4*a*, 4*a*'.

As shown in FIGS. 3 and 5, the guiding portions 5*d* are provided with a pair of securing pieces 20. On the other hand, the connector housing 5*j* on the side of the camera case 3 is provided with a pair of engagement portions corresponding to the pair of securing pieces 20.

In this way, when the camera module Y is combined with the camera case 3, the connector housing 5*b* is temporarily coupled with the connector housing 5*j* of the camera case 3 with the aid of the pair of securing pieces 20 and the pair of engagement portions 30. Thus, provisional fixing of the camera module Y and the camera case 3 is continued until they are securely fixed by screws.

Meanwhile, even if there is a transporting step of the camera module Z when it is assembled, owing to vibration, undue force may be applied between the caulking terminal 5*e* and the cable 4*a*, 4*a*' so that poor electric contact may occur at the area where good connection has been made. However, such an inconvenience can be avoided by this invention.

Further, when camera module Y is combined with the camera case 3, they may come off from each other inadvertently. A further combining operation increases the possibility of poor contact. Such an inconvenience can be also avoided by this invention.

Specifically, if the injured area of the cable 4*a*, 4*a*' is subjected to caulking, an electric poor contact may be generated again. In this case, the entire wire harness 4 inclusive of the cables 4*a*, 4*a*' must be replaced by a new wire harness, or otherwise a different area of the cable 4*a*, 4*a*' must be subjected to the caulking. This invention can remove the necessity of such a troublesome operation, and provide the camera module permitting easy handling.

In operation, when the camera module Y as shown in FIG. 5 is lowered toward the camera case 3 along an attaching direction S1, the inner face 5*d*' of the guiding portion 5*d* starts to fall into contact with the outer face 5*m*' of the side wall 5*k*' on the camera case 3. With the aid of the pair of guiding portions 5*d*, the camera module Y in a proper posture is lowered just under it toward the camera case 3.

As the camera module Y is lowered, owing to the slopes 21 of the securing pieces 20 of the connector housing 5*b*, the pair of guiding portions 5*d* try to expand smoothly in an opening direction. The ends of the parallel portions 22 move downward in slidable contact with the outer faces of 5*m*' of the connector housing 5*j*. In this case, the pair of guiding portions 5*d* move while they sandwich the connector housing 5*j* on the side of the camera case 3 so that the camera module Y does not lean excessively.

Thereafter, the securing pieces 20 on the side of the camera module Y and the engagement portions 30 on the side of the camera case 3 are engaged with each other. Once the securing pieces 20 and the engagement portions 30 are engaged with each other, the camera module Y and camera case 3 are provisionally coupled with each other at their respective vertical portions 23 and 33 so that they do not come off easily from each other. The camera module Z permitting easy handling on the way of assembling can be provided.

The camera case shown in FIGS. 1 to 4 has an accommodating chamber 3*e* encircled by a bottom wall 3*c* and four side walls 3*d* and 3*d*'. As seen from FIGS. 1 to 5, and FIG. 12, a mat seal 9 for improving the sealing property is formed integrally to the side wall 3*d*' of the camera case 3.

As seen from FIGS. 2 and 4, the mat seal 9 has internal through-holes 9*a* through which the cables 4*a*, 4*a*' are to be passed. In this way, the cables 4*a*, 4*a*' as shown in FIGS. 1 to 4, are extended into the camera case 3 through the mat seal.

Referring to FIGS. 2 and 4, a detailed explanation will be given of the shape of the mat seal 9. As seen from these figures, the mat seal 9 is integrally formed from the periphery of the through-hole 3*f* made in the side wall 3*d*' of the camera case 3 to the side wall 5*k*" of the connector housing 5*j*. In order that the mat seal 9 does not come off from the through-hole 3*f* of the camera case 3, the mat seal 9 is provided with securing portions 9*b* for preventing it from coming off on the side of the chamber 3*e*. The securing portions 9*b* are secured to the camera case 3 so that they are sandwiched between the inner face of the side wall 3*d*' of the camera case 3 and the outer face of the side wall 5*k*" of the connector housing 5*j*.

The mat seal 9 will be made as follows. First, the camera case 3 is manufactured by molding aluminum castings. Otherwise, the camera case 3 is molded using synthetic resin which can be subjected to injection molding and has thermoplastic property. The synthesized polymer such as fast silicon granules is poured into the peripheral portion of the camera case 3 inclusive of the through-hole 3*f*, and thereafter solidified in a prescribed shape to provide the mat seal 9.

In this case, with the cables 4*a*, 4*a*' being previously fixed to the through-hole 5*o* of the connector housing 5*j*, the cables 4*a*, 4*a*' and mat seal 9 may be integrated. On the other hand, with the through-holes 9*a* previously made in the mat seal 9, the cables 4*a*, 4*a*' may be passed through the though-holes of the mat seal 9.

Thus, the mat seal 8 is integrally formed on the side wall 5*k*" of the connector housing 5*j*. The cables 4*a*, 4*a*' sealed by the mat seal 9 are passed from an entrance case toward the chamber 5 of the connector housing 5*j*. The through-hole 3*f* made in the side wall 3*d*' is sealed by the mat seal 9.

The provision of the mat seal 9 permits the wires such as the cables 4*a*, 4*a*' to be passed from the outside of the camera case 3 to the inside thereof, and also prevents foreign materials such as water and dust from invading the inside of the camera case 3.

As seen from FIGS. 1, 2 and 4, bodies 3*a*, 3*a*' for securing the camera module Y are provided at the internal four corners of the camera case 3. Female screw corners 3*b* are formed in the corresponding bodies 3*a*, 3*a*'.

Referring to FIG. 1, an explanation will be given of the relative positions of the female screw holes 3*b*. When viewed from the side of the camera case 3 where the wire harness 4 is attached, the bodies 3*a* provided at two positions on this side are higher than the bodies 3*a*' provided at two positions on the deep side. Correspondingly, the female screw holes 3*b* of the bodies 3*a* on this side are located at a higher position than the female screw holes 3*b* of the bodies 3*a*'.

This is because the screw securing portions 1*a* of the camera 1 and the screw securing portions 2*a* of the base plate 2 are different in the height direction of the camera case 3 when the camera module Y composed of the camera 1 and the base plate 2 is combined with the camera case 3.

The camera body 1' is provided with two screw securing portions 1*a* and the base plate body 2' is also provided with two securing portion 2*a*. Since the camera 1 and the base plate 2 are combined with each other, the camera module Y is provided with total four screw-securing portions 1*a* and 2*a*. In this case, the screw-securing portions 1*a* and 2*a* of the camera module Y are located at different heights so that the screw-securing portions 3*a*, 3*a*' of the camera case 3 are correspondingly located at different heights.

The camera case 3 is preferably made of an aluminum alloy such as aluminum die casting which is lightweight and excellent in various viewpoints such as mechanical strength, corrosion resistance, workability, productivity, etc. It is important that the camera case 3 is made of the material having corrosion resistance since the CCD camera is exposed to the weather. The camera case 3 is preferably made of the material having a small specific gravity which contributes to the weight-reduction of a motor car. Concretely, the camera case 3 is preferably made of synthetic resin which can be injection-molded and has thermoplastic property because it is excellent in mass productivity.

As seen from FIGS. 1 to 5, the connector housing 5*j* is arranged at a prescribed position within the accommodating chamber 3*e* which constitutes the camera case 3. The connector housing 5*j* is integrated to the camera case 3 within the accommodating chamber 3*e* of the camera case 3. Although the connector housing 5*j* can be formed as a separate member, it is preferably integrated to the camera case 3 in order to reduce the number of components to realize size reduction and cost reduction.

Figure 11:
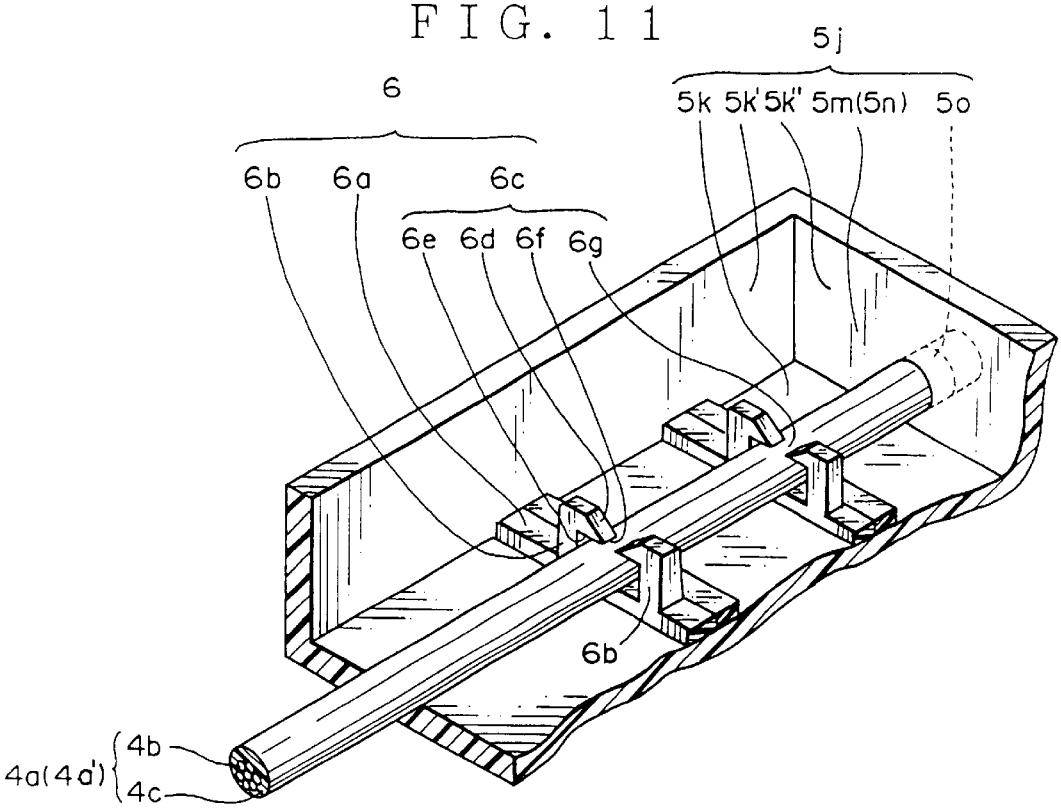
FIG. 11 is an enlarged perspective view of the state when the cables have been attached to a wire fixing portion.

As seen from FIGS. 2, 4 and 11, the connector housing 5*j* is encircled by a bottom wall 5*k* and side walls 5*k*' and 5*k*" to provide an accommodating chamber 5*m*. Further, as seen from FIG. 5, a lightening space 5*n*' is provided between the bottom wall 3*c* of the camera case 3 and the bottom wall 5*k* of the connector housing 5*j*. In this way, by providing the lightening space 5*n*' below the bottom wall 5*k* of the connector housing 5*j*, reduction in the weight and cost of the material can be realized. Accordingly, a light-weight and inexpensive camera module Z can be provided.

As seen from FIGS. 1 to 5, FIG. 11, the cables 4*a*, 4*a*' are mounted in the accommodating chamber 5*m* of the connector housing 5*j*. As seen from FIGS. 1, 2 and 11, the cables 4*a*, 4*a*' are held by wire fixing portions 6 provided on the bottom wall of the connector housing 5*j*. Further, the cables 4*a*, 4*a*' are aligned at regular intervals within the accommodating chamber.

In order that the caulking terminals 5*e* of the caulking connector 5*a* are connected to the cables 4*a*, 4*a*' located within the accommodating chamber 5*m*, an opening 5*n* is provided above the accommodating chamber 5*m*. When the camera module Y is combined with the camera case 3, the caulking terminals 5*e* enter the accommodating chamber 5*m* through the opening 5*n* and are caulked with the cables 4*a*, 4*a*', respectively.

As seen from FIGS. 1, 2 and 11, the wire fixing portions 6 are provided in a staggered manner around the cable 4*a*, 4*a*'. FIG. 11 is an enlarged perspective view of the vicinity of a connecting are 5*e* when the cable 4*a*, 4*a*' is attached to the wiring fixing portions 6. The connecting portion 5*e*' corresponds to the caulking connector 5*a* provided with the caulking terminals 5*e*.

As seen from FIG. 2, if the adjacent wiring fixing portions 6 are staggered within the accommodating chamber 5*m*, the accommodating space of the accommodating chamber can be reduced. Thus, the camera case 3 can be miniaturized so that the auxiliary machine module such as the camera module Z can be miniaturized.

As seen from FIGS. 2 and 11, the wire fixing portions 6 are arranged at at least two positions for each cable 4*a*, 4*a*'. In FIG. 11, a pair of wire fixing portions are attached to the cable 4*a*, 4*a*'. In FIG. 2, the wiring fixing portions 6 are provided at the two positions in their linear direction, and at a total of 12 positions In this way, since the cables 4*a*, 4*a*' are fixed at prescribed positions during the caulking, when the caulking blades 5*f* of the caulking terminal 5*e* as shown in FIG. 9 start to tear the cable 4*a*, 4*a*', the cable 4*a*, 4*a*' cannot escape from the caulking force of the blades 5*f* and surely receive the force. This realizes a preferred caulking connection.

Incidentally, the cables 4*a*, 4*a*' may not be fixed by the wire fixing portions, but may be fixed by the through-hole 5*o* made in the side wall 5*k*" of the connector housing 5*j* so that it is fixed more surely.

An explanation will be given of the shape of the wire fixing portion 6 as shown in FIGS. 1, 2 and 11. As seen more clearly from FIG. 11, the wiring fixing portion 6 is hook-shaped. Specifically, the wire fixing portion 6 is composed of a pair of inverted L-segments to provide a gate shape, for example.

As seen from FIG. 11, the wire fixing portion 6 is composed of a bottom plate 6*a*, posts 6*b* and locking pieces 6*c*. The posts 6*b* are extended upright from the bottom plate 6*a* and communicate with the locking pieces 6*c* which prevent the cables 4*a*, 4*a*' from coming off.

The locking pieces 6*c* each has a slope 6*d* which permits the cable 4*a*, 4*a*' to be easily fit in the wire fixing portion 6. However, the locking pieces 6*c* each has also a face 6*e* in parallel to the bottom plate 6*a*, which extends from the tip of the locking piece 6*a* to the post 6*b*. The face 6*e* serves to prevent the cable 4*a*, 4*a*' from coming off.

The gap 6*g* between the one tip 6*f* of the wire fixing portion 6 and the other tip 6*f* thereof is set at a distance that is shorter than the diameter of the cable 4*a*, 4*a*' so as to prevent the cable 4*a*, 4*a*' from easily coming off and permits the cable 4*a*, 4*a*' to be easily fit in the wire fixing portion 6.

The length of the post 6*b* from the bottom plate 6*a* to the parallel face 6*e* is set at a length which is slightly shorter than the diameter of the cable 4*a*, 4*a*'. In addition, the cable 4*a*, 4*a*' is sandwiched between the locking piece 6*c* and bottom plate 6*a* in order to prevent the cable 4*a*, 4*a*' from easily moving owing to the caulking force applied to the caulking blades 5*f* of the caulking terminal 5 during the caulking.

Additionally, in the caulking connection, in order to absorb an error or a swing when the respective components are attached, a slight play is required between the cable 4*a*, 4*a*' and the caulking blades 5*f*. To this end, the distance between the inside face of the one post 6*b* of the wire fixing portion 6 and the inside face of the other post 6*b* thereof is set at a length longer than the diameter of the cable 4*a*, 4*a*'.

Where the cable 4*a*, 4*a*' are fixed as described above, when the caulking blades 5*f* start to tear the cable 4*a*, 4*a*', the cable 4*a*, 4*a*' can receive the caulking force of the caulking blades 5*f*. This permits preferred caulking.

The wire fixing portion 6 is preferably made of synthetic resin which can be injection-molded and has thermoplastic property. In this case, the wire fixing portion 6 maybe made of the same material as that of the connector housing 5*j*, and may be integrated to the connector housing 5*j*. The wire fixing portion 6 may be separately provided as a component of a different material within the accommodating chamber 5*m* of the connector housing 5*j*. The wiring fixing portion according to this invention may be formed in any shape and made of any material.

Within the accommodating chamber 5*m* as shown in FIGS. 3 to 5, the wiring fixing portion 6 having a shape similar to that shown in FIG. 11 can be arranged. However, as shown in FIGS. 3 and 4, if the through-holes 5*o* through which the cables 4*a*, 4*a*' have been passed are provided and the distance between the two side walls 5*k*" is relatively short, the cable 4*a*, 4*a*' does not excessively deviate from the corresponding caulking terminal 5*e*. In such a case, the wire fixing portions are not required within the accommodating chamber 5*m* of the connector housing 5*j* on the camera case 3.

The cables 4*a*, 4*a*' are bundled by the tube 4*d* to provide the wire harness 4 which is to be connected to a prescribed position of a motor car. In order that other electric circuits can be also connected as occasion demands, the wire harness 4 may include a dummy wire as well as the cable 4*a* and the drain wire 4*a*'.

As seen from FIG. 2, the wire harness 4 connects the camera case 3 with a non-water-proofing connector 5*r* provided within a vehicle V. The drain wire 4*a*' which branches on the way from the wire harness 4 is provided with a terminal 5*s* at its one end and the terminal 5*s* is attached to a frame of a vehicle body B by a screw 13*c*. In this way, the drain wire 4*a*' serves as an earth. Thus, the base plate 3 equipped with the camera 1 is electrically connected to the wire harness 4, the non-water proofing connector 5*r*, drain wire 4*a*', etc.

As seen from FIGS. 1 to 4 and FIG. 12, an inlet case 7 is attached to the side wall 3*d*' of the camera case 3. The inlet case 7 is provided to prevent the wire harness 4 from suffering from undue bending force, protect the cables 4*a*, 4*a*' taken out from the tube 4*d* of the wire harness 4 and align the cables 4*a*, 4*a*' taken out from the tube 4*d*.

Although the inlet case 7 may be attached to the camera case 3 as a separate component, it is preferably integrated to the camera case 3 to reduce the number of components.

The inlet case 7 is composed of a bottom wall 7*a* and side walls 7*b*, 7*b*' encircling it to provide an accommodating chamber 7*c*. A guiding plate 7 dislocated in the accommodating chamber 7*c* to align the cables 4*a*, 4*a*' in parallel. Specifically, as seen from FIG. 12, guiding grooves 7*e* for appropriately guiding the cables 4*a*, 4*a*', are formed on the upper side of the guiding plate at six positions at regular intervals. As seen from FIGS. 1 to 4, a guiding portion 7*f* for the wire harness 4 is provided so as to extend along the wire harness from the side wall 7*b*' of the inlet case 7.

Figure 12:
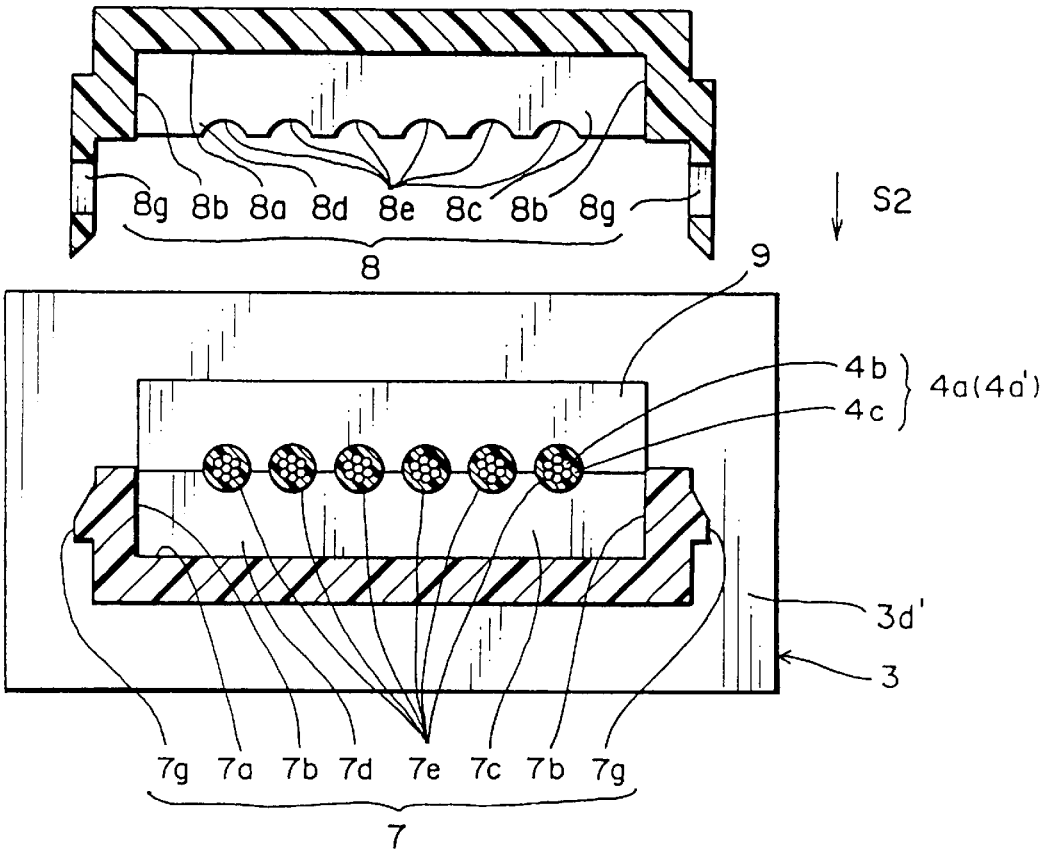
FIG. 12 is a sectional view of an entrance case and a cover therefor, taken in line P—P in FIG. 3.

As seen from FIGS. 1, 3 and 12, an inlet cover 8 corresponding to the inlet case 7 is prepared. FIG. 12 is a sectional view of the inlet case 7 and inlet cover 8 taken in line P—P in FIGS. 1 and 3. The inlet cover 8 is composed of a top wall 8*a* and side walls 8*b*, 8*b*' encircling it to provide an accommodating chamber 8*c*.

The inlet cover 8 is provided with a guiding plate 8*d* having guiding grooves 8*e* corresponding to the guiding grooves 7*e* of the guiding plate 7*d* of the inlet case 7. Specifically, guiding plate 8*d* for appropriately guiding the cables 4*a*, 4*a*' is provided within the accommodating chamber 8*c* of the inlet cover 8.

Specifically, as seen from FIG. 12, guiding grooves 8*e* for appropriately guiding the cables 4*a*, 4*a*', are formed on the lower side of the guiding plate 8*d* at six positions at regular intervals. Further, as seen from FIGS. 1 and 3, a guiding portion 8*f* for the wire harness 4 is provided so as to extend along the wire harness from the side wall 8*b*' of the inlet cover 8.

In this way, in a direction S2 in FIG. 12, the inlet case 7 is securely covered with the inlet cover 8 so that the cables 4*a*, 4*a*' are securely sandwiched between the guiding grooves 7*e* of the inlet case 7 and the guiding grooves 8*e* of the inlet cover 8. The guiding plates 7*d* and 8*d* provided with guiding grooves 7*e* and 8*e*, respectively can be referred to as ribs.

When the inlet case 7 is covered with the inlet cover 8, the guiding portions 7*f* and 8*f* are fit to each other. Therefore, the wire harness 4 is protected so that it does not suffer from undue bending force.

Because of provision of the guiding portions 7*f* and 8*f*, when the wire harness 4 is arranged or the assembled camera module Z is dealt with, the wire harness 4 does not curve in a sharp curve at the attaching portion where the wire harness is attached to the camera case 3 and hence the cables 4*a*, 4*a*' do not suffer from undue force.

As seen from FIGS. 1, 3 and 12, the inlet case 7 is provided with a pair of locking segments 7*g* formed on the side wall 7*b* of the inlet case 7, whereas the inlet cover 8 is provided with a pair of engagement segment 8*g* formed on the side wall 8*b* of the inlet cover 8. The inlet case 7 and inlet cover 8 are securely engaged with each other in such a manner that the locking segments 7*b* which have protrusive shapes are fit in the corresponding engagement segments 8*g* having engagement windows.

The inlet cover 8 is preferably made of synthetic resin which can be injection-molded and has thermoplastic property because it is excellent in mass productivity. The inlet cover 8 can be manufactured by the other technique than the injection molding. Where the camera case 3 is made of the same material as that of the inlet case 7 and inlet cover 8, the assembly can be mass-produced in a complicate shape.

Since the inlet cover 8 made of synthetic resin has suitable restoring force, when the locking segments 7*g* of the inlet case 7 are fit in the engagement segments 8*g* of the inlet cover 8, the engagement segments 8*g* are elastically deformed. Therefore, the locking segments 7*g* of the inlet case 7 can be easily fit in the engagement segments 8*g* of the inlet cover 8. As a result, the inlet case 7 and the inlet cover 8 are fit to each other quickly and easily.

For the reason described above, if the connector housing 5*b* of the caulking connector 5*a* and wiring fixing portion 6 are also made of the above synthetic resin, they can be formed into a molding body with suitable elastic force, and hence used as a light-weight and elastic component which can be satisfactorily attached to a complementary component.

The synthetic resin which can be injection-molded and has thermoplastic property includes e.g. polybutyleneterephthalate (PBT), acrylnitrile-butadiene stylene (ABS), polypropylene (PP), etc. The inlet cover 8 is made of e.g. polybutyleneterephthalate (PBT) which is excellent in size stability, strength stability, electric characteristic, etc.

Now referring to FIGS. 1 to 12, an explanation will be given of a method of manufacturing an auxiliary machine module such as the camera module Z, particularly a method of assembling the camera module Z as described above.

Various terminals such as various kinds of caulking terminals 5*e* and various bus bars are made in prescribed shapes from a metallic material by punching or bending. On the other hand, the base plate is prepared from thermosetting resin, and the connector housing 5*b* is injection-molded from thermoplastic resin. Various electric components such as the various bus bars and connector housing 5*b* equipped with the caulking terminals 5*e* are attached to the base plate 2.

The camera 1 which includes a lens 1*c*, a lens peripheral portion 1*d*, a camera 1, etc. as shown in FIG. 1 is previously prepared. As shown in FIG. 1, the camera 1 is combined with the base plate 2 having the caulking connector 5*a* equipped with the caulking terminals 5*e* and other various electric circuits to prepare the camera module Y.

On the other hand, the camera case 3 equipped with the connector housing 5*j* and inlet case 7 as shown in FIG. 1, inlet cover 8 and the wiring fixing portion 6 are previously manufactured of the synthetic resin which can be subjected to the injection molding and has a thermoplastic property. As seen from FIGS. 2 and 11, the wire fixing portion 6 is attached to a prescribed position within the connector housing 5*j*, or integrally molded with the connector housing 5*j* using the same material.

As regards the wire harness 4 as shown in FIG. 2, the cables 4*a*, 4*a*' are previously taken out from the tube 4*d* by tearing it so that the cables 4*a*, 4*a*' are extended from the tube 4*d* by a prescribed length.

The cables 4*a*, 4*a*' are passed through the through-holes 5*o* formed on the side wall 5*k*" of the connector housing 5*j*, respectively, and attached to the wire fixing portions 6 located within the accommodating chamber 5*m* of the connector housing 5*j*. The cables 4*a*, 4*a*' each is securely fixed to two wire fixing portions 6.

As occasion demands, the cables 4*a*, 4*a*' may be fixed to the side wall 5" by using adhesive so that the cables 4*a*, 4*a*' can be fixed to the side wall 5" more securely.

As seen from FIGS. 1 to 4 and 12, the cables 4*a*, 4*a*' are securely aligned on the guiding grooves 7*e* formed in the guiding plate 7*d* of the inlet case 7. Subsequently, the synthetic polymer such as the fast granular silicon is poured into the through-hole 3*f* of the camera case 3 and solidified into a prescribed shape to the mat seal 9.

The camera module Y is securely accommodated into the camera case 3. In the process of this operation, the caulking blades 5*f* of each caulking terminal 5*e* tears the insulating coating 4*c* of the cable 4*a*, 4*a*' arranged in the connector housing 5*j* so that they are brought into contact with the insulating coating 4*c*. Thus, the caulking connection is made within the camera module Z. In this way, by securely accommodating the camera module Y within the camera case 3, the base plate 2 or camera module Y is electrically connected to the camera case 3 with the aid of the connector 5.

In accordance with this invention, unlike the conventional camera module Z as shown in FIG. 14, the camera module Z can be assembled without performing the troublesome operation that the connector housing 5*q* equipped with terminals is attached to the cables 4*a*, 4*a*', is passed through the through-hole of the camera case and thereafter connected to the connector housing 2*c* attached to the base plate 2 equipped with terminals so that as shown in FIG. 15, the base plate 2 is electrically connected to the cables 4*a*, 4*a*'. Therefore, in accordance with this invention, the camera module Z can be assembled quickly and effectively.

In accordance with this invention, the problem which may occur when the camera module Y is combined with the camera case 3 as shown in FIGS. 14 and 15, can be solved. Specifically, such an inconvenience can be overcome that when the base plate 2 is combined with the camera case 3, the cables 4*a*, 4*a*' are caught between the base plate 2 and the camera case 3.

More specifically, in the conventional camera module Z as shown in FIG. 15, when the camera module Y is mounted in the came case 3, the redundant portion of the cables 4*a*, 4*a*' may extend off between the camera module Y and the camera case 3. Therefore, when the camera module Y is attached to the camera case 3, because of the redundant portion extended off, the cables 4*a*, 4*a*' will be caught between the camera module Y and camera case 3. Such an inconvenience does not occur in this invention.

Thus, the operator is not required to perform the assembling operation carefully so that the cables 4*a*, 4*a*' are not caught between the base plate 2 and the camera case 3. Further, when an automated assembling machine is used, it does not catch the cables 4*a*, 4*a*' and so not stop. Therefore, the cables 4*a*, 4*a*' are not injured so that the production yield of the camera module Z in the manufacturing process is not lowered.

Now referring to FIGS. 1 and 3, a concrete explanation will be given of a method of manufacturing an auxiliary module according to this invention. The camera base plate 2 equipped with the caulking connector 5*a* is attached to the camera 1 to assemble the camera module Y. On the other hand, the cables 4*a*, 4*a*' are securely aligned at regular intervals in the accommodating chamber 5*m* attached to the camera case 3. Simultaneously when the camera module Y equipped with the base plate 2 is mounted in the camera case 3, the caulking terminals 5*e* attached to the camera module Y are caulked with the cables 4*a*, 4*a*' of the camera case 3.

In accordance with such a method of manufacturing the camera module, the camera module can be assembled more easily than the conventional assembling operation. Thus, the assembling operation can be simplified, and the efficiency of operability can be improved. In the manufacturing process, using the caulking-connection of the caulking terminals 5*e*, the assembling operation of the camera module and the electric connection therefore can be simultaneously carried out.

By assembling the camera module Z as described above, i.e. mounting the camera module Y in the camera case 3, the electric connection can be made. The caulking-connection using the caulking terminals 5*e*, as described in connection with FIGS. 8 to 10, permits peeling of the insulating coating 4*c* and connection of the conductor 4*b* to be carried out simultaneously. This connecting method is very efficient.

Figure 13:
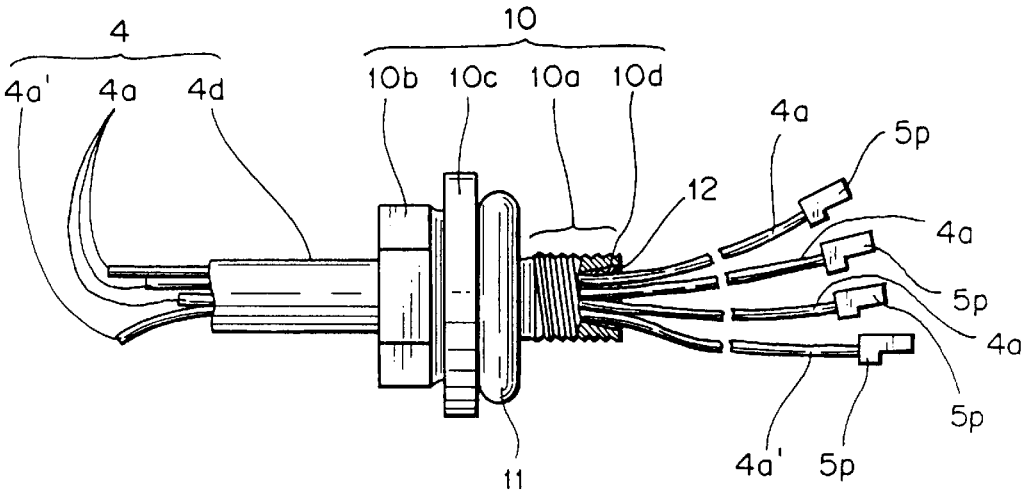
FIG. 13 PRIOR ART
FIG. 13 is a partially enlarged view of the wire harness mounted in a clamp equipped with an O ring.

This invention can avoid the troublesome operation in the conventional connecting method described with reference to FIG. 13 that after the insulating coating of the cable 4*a*, 4*a*' has been removed to expose the internal conductor, the conductor is connected to the crimping terminal to provide the terminal 5*p*, and the prescribed crimping terminals are connected to each other.

Figure 16:
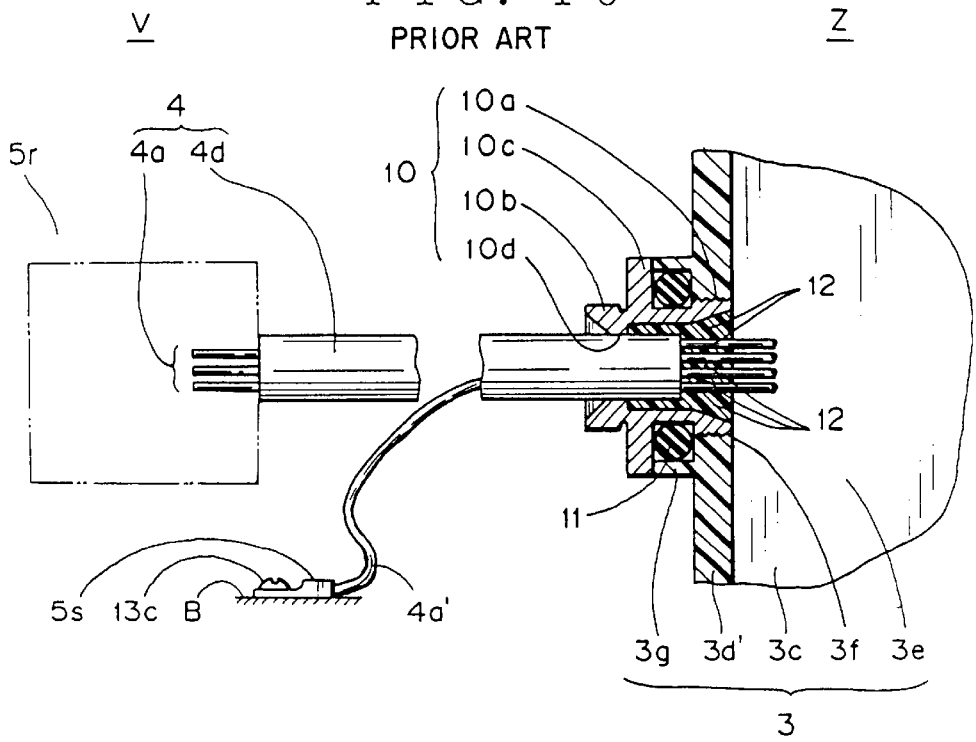
FIG. 16 PRIOR ART
FIG. 16 is an enlarged sectional view taken in line R—R in FIGS. 14 and 15.

Unlike the prior art as shown in FIGS. 14 to 16, in accordance with this invention, the camera module Z can be assembled without performing the troublesome operation that the connector housing 5*q* equipped with terminals is attached to the cables 4*a*, 4*a*', is passed through the through-hole of the camera case and thereafter connected to the connector housing 2*c* attached to the base plate 2 equipped with terminals so that as shown in FIG. 15, the base plate 2 is electrically connected to the cables 4*a*, 4*a*'. Therefore, in accordance with this invention, the camera module Z can be assembled quickly and effectively.

In this invention, although the caulking connection was performed using the caulking terminals 5*e*, male-female connectors in any other format may be used.

After the camera module Y shown in FIGS. 1 and 3 have been accommodated in the camera case 3 in an attaching direction S1, four screws 13*a* are passed through the through-holes 1*b*, 2*b* formed at the screwing portions 1*a*, 2*a*. The attaching direction S1 is vertically oriented so that the flat portion of the camera body 1' or base plate 2' is in parallel to the bottom wall 3*c* of the camera case 3.

The screws 13*a* are screwed into the female screw holes 3*b* of the securing pieces 3*a*, 3*a*' provided at the four corners of the camera case 3 using the screwing tool. In this case also, the caulking-connection can be carried out more surely. As occasion demands, the cover for protecting the auxiliary machine 1 may be attached to the camera case 3.

As seen from FIG. 12, since the inlet cover 8 is made with the inlet case 7, the cables 4*a*, 4*a*' are surely fixed by the guiding grooves 7*e* and guiding grooves 8*e*.

The camera module Y as shown in FIG. 1 may be combined with the camera case 3 in which the connector housing is accommodated as shown in FIGS. 3 and 4. In this case, the engagement pieces 30 shown in FIGS. 3 and 4 may not be processed.

The auxiliary machine module used in this invention may include an auxiliary module used in an instrument panel of a motor vehicle and its peripheral portion.

However, the auxiliary machine module is preferably the camera module including the CCD camera 1 attached to the motor vehicle. Use of the camera module Z attached to the motor vehicle permits the number of peripheral components of the camera module Z to be reduced.

In accordance with this invention, the assembling structure of the camera 1, base plate 2 and camera case 3 can be simplified. Specifically, as shown in FIGS. 1, 3 and 5, use of the caulking terminals 5*e* makes it unnecessary to use the structure of the conventional camera module as shown in FIGS. 13 and 16 in which the cables 4*a*, 4*a*' equipped with the terminals 5*p* is combined with the connector housing 5*q* and thereafter, as shown in FIGS. 14 and 15, the connector housing 5*q* is connected to the connector housing 2*c* of the base plate 2.

In accordance with this invention, since the caulking terminals 5*e* of the caulking connector 5*a* as shown in FIGS. 1, 3 and 5 are electrically connected to the cables 4*a*, 4*a*' arranged in the chamber 5*m* on the side of the camera case 3, inspection, dismantle and repair of the camera module can be made easily. Easiness of dismantle of the camera module contributes to recycling thereof.

The camera module according to this invention is used in a motor vehicle, a large-scale car such as a bus, etc. The camera module is attached to a region in a blind spot of the front of the motor vehicle, or a rear thereof from which a rear field of vision can be ascertained. Thus, the camera module can be used to ascertain the blind spot.

Meanwhile, when the motor car backs, the in-vehicle CCD camera attached to the exterior of the rear of the car may bump against any other object. In this case, the CCD camera must be inspected and repaired. However, the in-vehicle CCD camera to which this invention should be applied can be easily dismantled, and repaired. Therefore, the CCD camera to which this invention can be applied is preferably attached to the rear of the vehicle in order to ascertain the field of vision.

Since the CCD camera to which this invention can be applied, when it is out of order, can be easily removed, inspected and repaired, its maintenance can be made very easily. Further, since the camera module Z out of order can be also dismantled easily, it is not directly disposed of, but can be recycled.

What is claimed is:

1. An auxiliary machine module comprising:

an auxiliary machine;

a base plate mounting said auxiliary machine and carrying a first connector housing having a caulking connector which is electrically connected to said auxiliary machine, said caulking connector containing a plurality of laterally spaced caulking terminals;

a case to which said base plate is mounted, said case containing a second connector housing operative to cooperate with said first connector housing for electrically connecting said base plate and said case, said second connector housing securing a plurality of extended, laterally spaced electric wires, being disposed for reception of the respective caulking terminals of said caulking connector when said base plate is installed in said case, and connector means for electrically connecting said base plate and said case.

2. An auxiliary machine module according to claim 1, wherein said connector means is activated when said base plate is mounted to said case so that the caulking terminals are caulking-connected to the electric wires.

3. An auxiliary machine module according to claim 1, wherein said auxiliary machine is a camera attached to a motor vehicle so that said auxiliary machine module constitutes a camera module.

4. An auxiliary machine module comprising:

an auxiliary machine;

a base plate mounting said auxiliary machine and carrying a caulking connector;

a case to which said base plate is mounted, and the caulking connector including connector means for electrically connecting said base plate and said case, said caulking connector being composed of a first connector housing mounting caulking terminals and said case has a second connector housing in which electric wires are housed, and said connector means is activated when said base plate is mounted to said case so that the caulking terminals are caulking-connected to the electric wires, wherein said first connector housing has a wall from which said caulking terminals extend, a pair of guiding walls extending from said wall substantially parallel to said caulking terminals to be brought into sliding-contact with cooperating walls of the said second connector housing before said caulking terminals are caulking-connected to the wires, respectively.

5. An auxiliary machine module according to claim 4, wherein said guiding walls are longer than the caulking terminals and shorter than a height of the cooperating walls of said second connector housing.

6. An auxiliary machine module according to claim 4, wherein said first connector housing has a pair of locking pieces and said second connector housing has a pair of engagement portions to be engaged with said pair of locking pieces.

7. A method of manufacturing an auxiliary machine module in which an auxiliary machine is electrically connected to a case, comprising the steps of:

mounting electric wires in exposed, mutually spaced parallel relation in a housing carried by said case;

providing a base plate suitable for mounting on said case;

attaching to said base plate an auxiliary machine and a caulking connector including a first connector housing having caulking terminals electrically connected to said auxiliary machine; and attaching said base plate to said case while simultaneously connecting said caulking terminals to said electric wires for supplying electricity to said auxiliary machine.

8. A method of manufacturing an auxiliary machine module according to claim 7, wherein said base plate has a caulking connector composed of a first connector housing and caulking terminals and said case has a second connector housing in which electric wires are housed, and said connector means is formed when said base plate is attached to said case to that the caulking terminals are caulking-connected to the electric wires.

9. A method of manufacturing an auxiliary machine module according to claim 7, wherein said auxiliary machine is a camera attached to a motor vehicle so that said auxiliary machine module constitutes a camera module.

* * * * *